US009427676B2

(12) United States Patent
Howard

(10) Patent No.: US 9,427,676 B2
(45) Date of Patent: Aug. 30, 2016

(54) SYSTEMS AND METHODS FOR ENHANCED BUILDING BLOCK APPLICATIONS

(71) Applicant: T. Dashon Howard, Plymouth Meeting, PA (US)

(72) Inventor: T. Dashon Howard, Plymouth Meeting, PA (US)

( * ) Notice: Subject to any disclaimer, the term of this patent is extended or adjusted under 35 U.S.C. 154(b) by 0 days.

(21) Appl. No.: 14/539,829

(22) Filed: Nov. 12, 2014

(65) Prior Publication Data

US 2016/0129361 A1 May 12, 2016

(51) Int. Cl.
*A63H 33/04* (2006.01)

(52) U.S. Cl.
CPC ..... *A63H 33/046* (2013.01)

(58) Field of Classification Search
CPC ..... A63H 33/00; A63H 33/04; A63H 33/08; A63H 33/16; A63H 33/40; G01N 33/26; G01N 33/32; B21D 5/00; B21D 11/00; B21D 11/20
USPC ..... 446/85, 90, 91, 108, 124, 477, 484; 428/182–184; 52/80.1, 81.6; D21/492
See application file for complete search history.

(56) References Cited

U.S. PATENT DOCUMENTS

| | | | | |
|---|---|---|---|---|
| 1,292,188 | A | 1/1919 | Wheeler | |
| 2,688,820 | A | 9/1954 | Shemet | |
| 2,843,971 | A | 7/1958 | Gardellin | |
| 3,359,657 | A | 12/1967 | Hedberg | |
| 3,564,758 | A | 2/1971 | Willis | |
| 3,654,375 | A | 4/1972 | Geiger | |
| 3,655,201 | A | 4/1972 | Nichols | |
| 3,662,486 | A | 5/1972 | Freedman | |
| 3,666,607 | A | 5/1972 | Weissman | |
| 3,728,201 | A | 4/1973 | Stroehmer | |
| 3,782,029 | A | 1/1974 | Bardot | |
| 3,785,066 | A | 1/1974 | Tuitt | |
| 3,788,934 | A * | 1/1974 | Coppa | A63H 33/16 428/12 |
| 4,026,087 | A | 5/1977 | White | |
| 4,064,662 | A | 12/1977 | O'toole | |
| 4,258,479 | A | 3/1981 | Roane | |
| 4,380,133 | A | 4/1983 | Arnstein | |

(Continued)

FOREIGN PATENT DOCUMENTS

| | | | |
|---|---|---|---|
| BE | 898431 | A1 | 6/1984 |
| CA | 2214697 | A1 | 6/1998 |

(Continued)

OTHER PUBLICATIONS

"U.S. Appl. No. 14/029,630, Notice of Allowance mailed Jul. 8, 2015", 5 pgs.

(Continued)

*Primary Examiner* — William Gilbert
(74) *Attorney, Agent, or Firm* — Schwegman Lundberg & Woessner, P.A.

(57) ABSTRACT

A curvilinear tetrahedral enhanced building block may be formed. The block may include sigmoid or reverse sigmoid curve edges, and may include curved vertices. The shape various planes or vertices of the block may be selected or adjusted to exert a force against a surrounding viscous medium. The block may include a conductive element configured to generate an electrostatic field, and may include a magnetic element configured to generate a magnetic field. The block may be configured to conduct electricity to a surrounding dielectric fluid, and the block's generation of a magnetic field may induce magnetohydrodynamic motion within the dielectric fluid.

18 Claims, 29 Drawing Sheets

(56) References Cited

U.S. PATENT DOCUMENTS

| | | | | |
|---|---|---|---|---|
| 4,492,723 | A * | 1/1985 | Chadwick, II | A63H 33/16 428/11 |
| 4,651,479 | A * | 3/1987 | Kersavage | E04B 1/3211 52/80.1 |
| 4,864,796 | A | 9/1989 | Diamond | |
| 5,104,125 | A | 4/1992 | Wilson | |
| 5,108,100 | A | 4/1992 | Essebaggers et al. | |
| 5,205,556 | A | 4/1993 | Stallman | |
| 5,429,515 | A | 7/1995 | Greenwood | |
| 5,489,230 | A | 2/1996 | Gavula, Jr. | |
| 5,895,306 | A | 4/1999 | Cunningham | |
| 5,961,365 | A | 10/1999 | Lambert et al. | |
| 6,264,199 | B1 | 7/2001 | Schaedel | |
| D457,833 | S | 5/2002 | Juan et al. | |
| 6,431,936 | B1 | 8/2002 | Kiribuchi | |
| 6,443,796 | B1 | 9/2002 | Shackelford | |
| 6,524,161 | B1 | 2/2003 | Asami | |
| 6,585,553 | B1 | 7/2003 | Fetridge et al. | |
| 6,895,722 | B1 | 5/2005 | Ponder | |
| 7,018,690 | B2 | 3/2006 | Lee | |
| 7,708,615 | B2 | 5/2010 | Munch | |
| 8,047,889 | B2 | 11/2011 | Ishii | |
| D660,685 | S | 5/2012 | Bucci | |
| 8,398,268 | B2 | 3/2013 | Elberbaum et al. | |
| 8,507,778 | B2 | 8/2013 | Olson | |
| 8,753,164 | B2 | 6/2014 | Hansen et al. | |
| 8,911,275 | B2 | 12/2014 | Maddocks et al. | |
| 8,961,258 | B2 * | 2/2015 | Balint | A63H 33/065 446/108 |
| 8,979,608 | B2 | 3/2015 | Hawthorne | |
| 9,168,465 | B2 | 10/2015 | Howard | |
| 9,192,875 | B2 | 11/2015 | Howard | |
| 2001/0041493 | A1 | 11/2001 | Esterle | |
| 2003/0153243 | A1 | 8/2003 | Haas | |
| 2006/0252340 | A1 | 11/2006 | Bach et al. | |
| 2007/0037469 | A1 | 2/2007 | Yoon | |
| 2008/0073999 | A1 | 3/2008 | Wischnewskij et al. | |
| 2009/0309302 | A1 | 12/2009 | Langin-Hooper | |
| 2011/0001394 | A1 | 1/2011 | Dalla Piazza | |
| 2011/0043079 | A1 | 2/2011 | Shirai et al. | |
| 2012/0122059 | A1 | 5/2012 | Schweikardt et al. | |
| 2013/0165012 | A1 | 6/2013 | Klauber et al. | |
| 2013/0217294 | A1 | 8/2013 | Karunaratne | |
| 2014/0227934 | A1 | 8/2014 | Rudisill | |
| 2015/0079870 | A1 | 3/2015 | Howard | |
| 2015/0079871 | A1 | 3/2015 | Howard | |
| 2015/0079872 | A1 | 3/2015 | Howard | |
| 2015/0283474 | A1 | 10/2015 | Howard | |

FOREIGN PATENT DOCUMENTS

| | | | |
|---|---|---|---|
| CN | 201643725 | U | 11/2010 |
| DE | 19617526 | A1 | 5/1997 |
| EP | 0261753 | A2 | 3/1988 |
| FR | 2114528 | A5 | 6/1972 |
| GB | 1603060 | A | 11/1981 |
| GB | 2302344 | A | 1/1997 |
| KR | 200454067 | Y1 | 6/2011 |
| WO | WO-9535142 | A1 | 12/1995 |
| WO | WO-2006040852 | A1 | 4/2006 |
| WO | WO-2008043535 | A1 | 4/2008 |
| WO | WO-2015042172 | A1 | 3/2015 |
| WO | WO-2015077760 | A1 | 5/2015 |
| WO | WO-2015116928 | A1 | 8/2015 |
| WO | WO-2015153827 | | 10/2015 |

OTHER PUBLICATIONS

"U.S. Appl. No. 14/170,372, Non Final Office Action mailed May 18, 2015", 7 pgs.

"U.S. Appl. No. 14/170,372, Notice of Allowance mailed Oct. 8, 2015", 7 pgs.

"U.S. Appl. No. 14/170,372, Response filed Aug. 18, 2015 to Non Final Office Action mailed May 18, 2015", 8 pgs.

"U.S. Appl. No. 14/245,249, Non Final Office Action mailed Jun. 30, 2015", 7 pgs.

"U.S. Appl. No. 14/245,249, Response file Oct. 28, 2015 to Non-Final Office Action mailed Jun. 30, 2015", 11 pgs.

"International Application Serial No. PCT/US2014/056130, International Preliminary Report on Patentability mailed Sep. 30, 2015", 6 pgs.

"International Application Serial No. PCT/US2015/013766, International Search Report mailed May 11, 2015", 4 pgs.

"International Application Serial No. PCT/US2015/013766, Written Opinion mailed May 11, 2015", 5 pgs.

"International Application Serial No. PCT/US2015/023973, International Search Report mailed Jun. 18, 2015", 4 pgs.

"International Application Serial No. PCT/US2015/023973, Written Opinion mailed Jun. 18, 2015", 5 pgs.

"U.S. Appl. No. 14/029,630, Non Final Office Action mailed Oct. 7, 2014", 5 pgs.

"U.S. Appl. No. 14/029,630, Response filed Jan. 7, 2015 to Non Final Office Action mailed Oct. 7, 2014", 6 pgs.

"U.S. Appl. No. 14/089,599, Response filed Dec. 22, 2014 to Restriction Requirement mailed Oct. 22, 2014", 6 pgs.

"U.S. Appl. No. 14/089,599, Restriction Requirement mailed Oct. 22, 2014", 6 pgs.

"Ball of Whacks", [online]. (c) 1996-2013, Amazon.com, Inc. [archived on Sep. 1, 2013]. Retrieved from the Internet: <URL: https://web.archive.org/web/20130901214911/http://www.amazon.com/Creative-Whack-BOW30-Ball-Whacks/dp/0911121013>, (2013), 5 pgs.

"International Application Serial No. PCT/US2014/056130, International Search Report mailed Nov. 27, 2014", 5 pgs.

"International Application Serial No. PCT/US2014/056130, Written Opinion mailed Nov. 27, 2014", 5 pgs.

"Magna-Tiles Clear Colors 32 piece set", [online]. (c) 1996-2013, Amazon.com, Inc. [archived on Sep. 8, 2013]. Retrieved from the Internet: <http://www.amazon.com/Magna-Tiles-Clear-Colors-piece-set/dp/B000CBSNKQ/>, (2013), 5 pgs.

"Toy / Game Popular Playthings Mag-Blocks", [online]. (c) 1996-2014, Amazon.com, Inc. [retrieved on Apr. 28, 2014]. Retrieved from the Internet: <URL: http://www.amazon.com/Game-Popular-Playthings-Mag-Blocks-Easy-To-Handle/dp/BOOCGG75JA/>, (2014), 3 pgs.

"U.S. Appl. No. 14/029,630, Notice of Allowance mailed May 8, 2015", 5 pgs.

"U.S. Appl. No. 14/029,630, Response filed Feb. 27, 2015 to Non Final Office Action mailed Feb. 23, 2015", 9 pgs.

"U.S. Appl. No. 14/089,599, Notice of Allowance mailed Apr. 2, 2015", 6 pgs.

"U.S. Appl. No. 14/089,599, Response filed Mar. 13, 2015 to Non Final Office Action mailed Feb. 23, 2015", 7 pgs.

"U.S. Appl. No. 14/170,372, Response filed Apr. 23, 2015 to Restriction Requirement mailed Feb. 26, 2015", 6 pgs.

"U.S. Appl. No. 14/170,372, Restriction Requirement mailed Feb. 26, 2015", 5 pgs.

"International Application Serial No. PCT/US2014/067330, International Search Report mailed Feb. 17, 2015", 4 pgs.

"International Application Serial No. PCT/US2014/067330, Written Opinion mailed Feb. 17, 2015", 7 pgs.

"U.S. Appl. No. 14/029,630, Non Final Office Action mailed Oct. 7, 2014", 7 pgs.

"Ball of Whacks", [online]. (c) 1996-2013, Amazon.com, Inc. [archved on Sep. 1, 2013]. Retrieved from the Internet: <URL: https://web.archive.org/web/20130901214911/http://www.amazon.com/Creative-WhackBOW30-Ball-Whacks/dp/0911121013>, (2013), 5 pgs.

"Toy / Game Popular Playthings Mag-Blocks", [online]. (c) 1996-2014, Amazon.com, Inc. [retrieved on Apr. 28, 2014]. Retrieved from the Internet: <URL: http://www.amazon.com/Game-Popular-Playthings-Mag-Blocks-Easy-To-Handle/dp/B00CGG75JA/>, (2014), 3 pgs.

* cited by examiner

SYSTEMS AND METHODS FOR ENHANCED BUILDING BLOCK APPLICATIONS

CROSS-REFERENCE TO RELATED APPLICATIONS

The present application is related to U.S. patent application Ser. No. 14/170,372, filed Jan. 31, 2014, which is a continuation-in-part of U.S. patent application Ser. No. 14/089,599, filed Nov. 25, 2013, which is a continuation-in-part of U.S. patent application Ser. No. 14/029,630, filed Sep. 17, 2013, the entire disclosures of which are incorporated herein by reference.

FIELD

The present invention relates to building blocks, and specifically to magnetic educational toy blocks.

BACKGROUND

Building blocks may be assembled in various configurations to form different geometric structures. Groups of building blocks may be used as an educational toy by children, or may be used by adults or children to explore various two-dimensional or three-dimensional shapes.

DETAILED DESCRIPTION

Enhanced building blocks may be formed from one or more basic shapes. Enhanced building blocks may include magnetic materials (e.g., magnets, ferromagnetic metals), piezoelectric materials, or lights (e.g., LEDs). Enhanced building blocks may be combined to form or give the appearance of various geometric structures, and the included magnetic materials may be used to retain the formed geometric structure shape. An enhanced building block may be formed from a tetrahedral building block, and may be referred to as an "un-shape" building block.

In the following description, reference is made to the accompanying drawings that form a part hereof, and in which is shown by way of illustration specific embodiments that may be practiced. These embodiments are described in sufficient detail to enable those skilled in the art to practice the invention, and it is to be understood that other embodiments may be utilized and that structural, logical, and electrical changes may be made without departing from the scope of the present invention. The following description of example embodiments is, therefore, not to be taken in a limited sense, and the scope of the present invention is defined by the appended claims.

Figure 1:
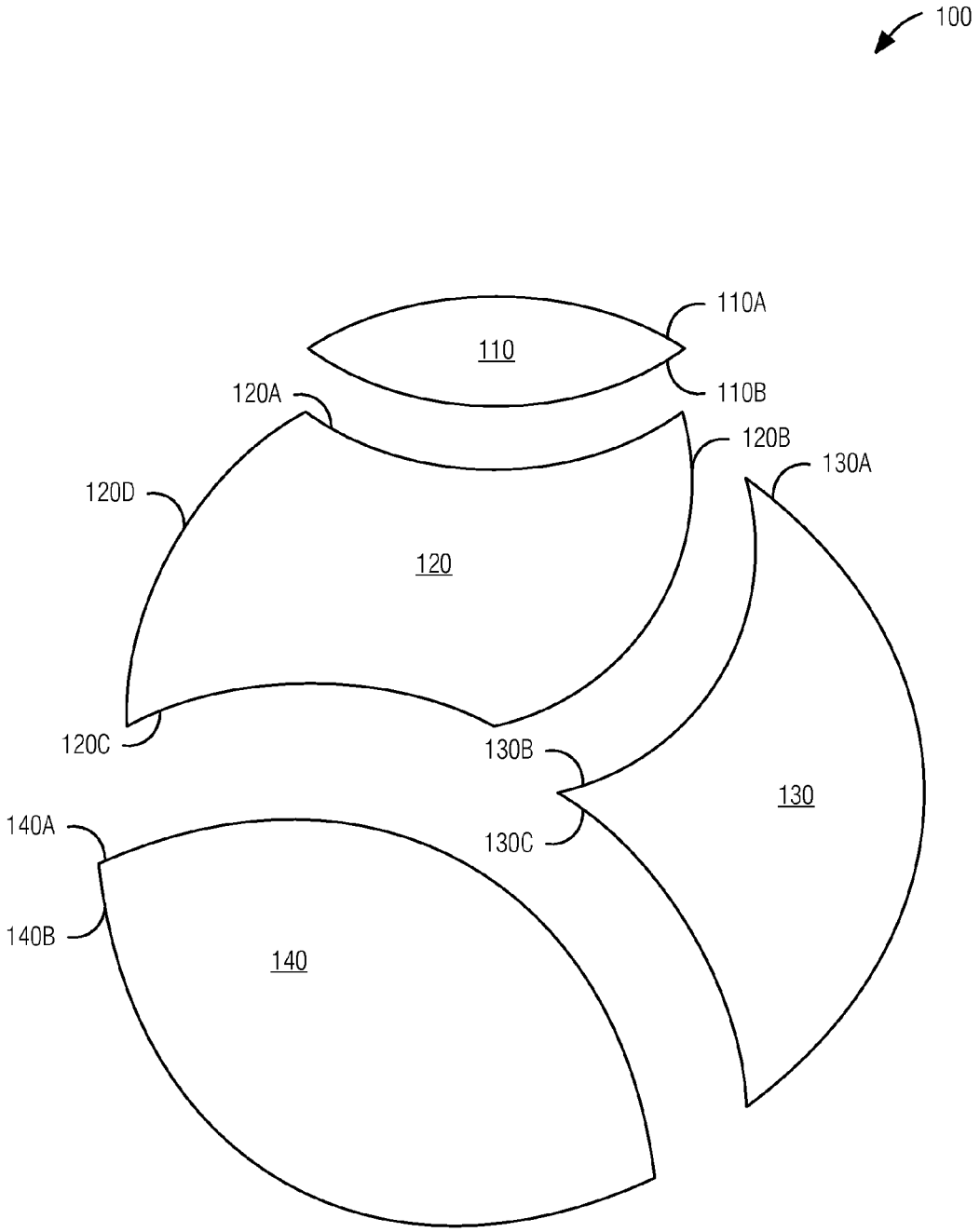
FIG. 1 is a front view of a first set of shapes that may be used to form a first enhanced building block.

Multiple enhanced building blocks may be combined using a template (e.g., visual guide). The template may serve as an outline for various arrangements of enhanced devices. The template may include a continuous background of a particular color, or the template may include one or more lines to suggest a preferred arrangement of enhanced devices, such as is shown in FIG. 1. The template may be two-dimensional or three-dimensional. For example, the template could be shaped as a flat circle or square, or the template could be shaped as a hemisphere or open cube. The template may be designed to accommodate one or more two-dimensional or three-dimensional enhanced devices. For example, multiple curved enhanced devices may be arranged to fill a hemispherical template. Variously shaped surfaces may be formed from a two-dimensional template, and the surfaces may be connected on a portion of their surface or along a portion or entire length of an edge to form three-dimensional shapes.

FIG. 1 is a front view of a first set of shapes 100 that may be used to form a first enhanced building block, according to an embodiment. In an embodiment, a circular shape is separated using a plurality of arcs to form one or more shapes 110, 120, 130, and 140. Edges of shapes are referenced using incremental reference letters corresponding to each shape, such as the two edges of shape 110 are edge 110A and edge 110B, and the four edges of shape 120 are edges 120A-120D. This reference numeral and letter convention is applied throughout this disclosure.

The arcs used to form various shapes may be of integer multiple arc lengths. For example, arc 110A may be congruent to arc 110B, 120A-120D, and 130A-120B, and may be half of the arc length of 130A and 140A-B. In this example, arcs 110A, 120D, 130A, and 140B form the circumference of the circle, and therefore arcs 110A and 120D may subtend angles of thirty degrees each and arcs 130A and 140B may subtend angles of sixty degrees each. In other examples, arcuate members may be circular arcs described by a constant radius consistent with a circle, may be described by major and minor radii consistent with an ellipse, or may be described by another shape. The arcuate member shapes may be selected to coincide with other arcuate members, either in coupling together to form a two-dimensional shape or in coupling together to form a three-dimensional shape with one or more common vertices. For example, arc 110A may be congruent to arc 110B, allowing adjacent edges of three copies of shape 110 to couple together to form the building block shown in FIGS. 2A-2B. Similarly, arcs 120A-D may be mutually congruent, allowing adjacent edges of four copies of shape 120 to form the building block shown in FIGS. 3A-3B.

Figure 2A:
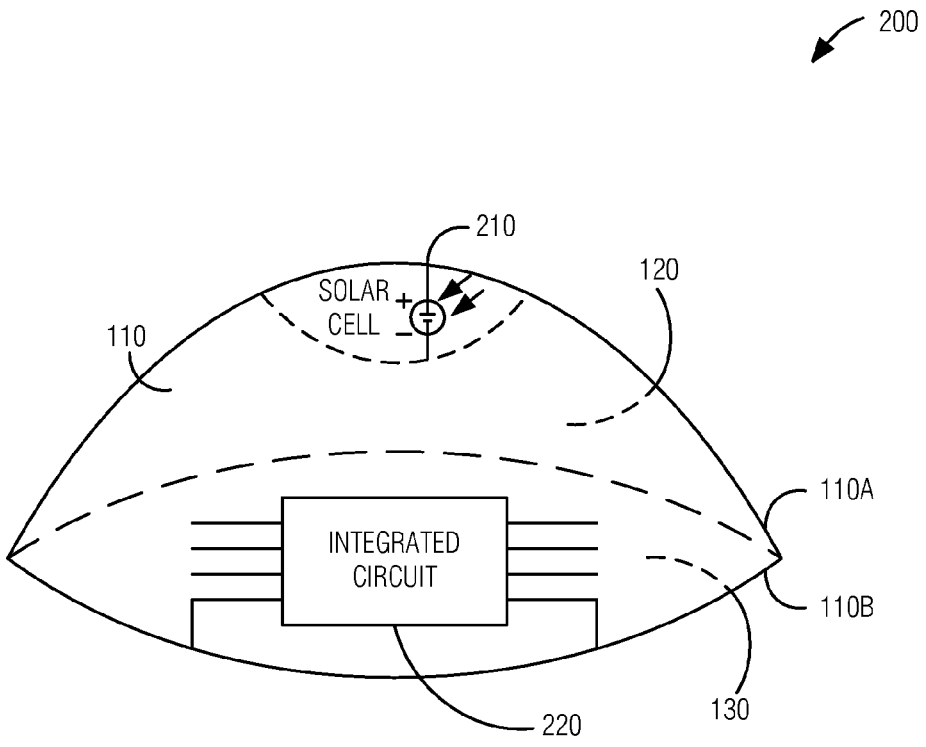
FIGS. 2A-2B are perspective views of a first example enhanced building block.
Figure 2B:
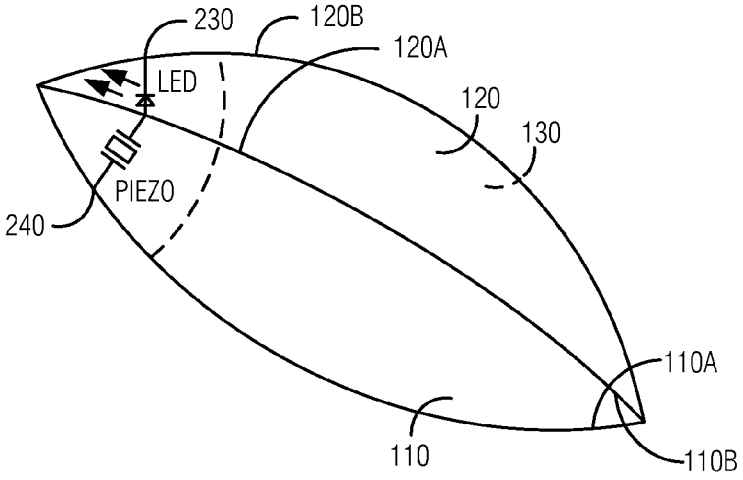
Figure 15A:
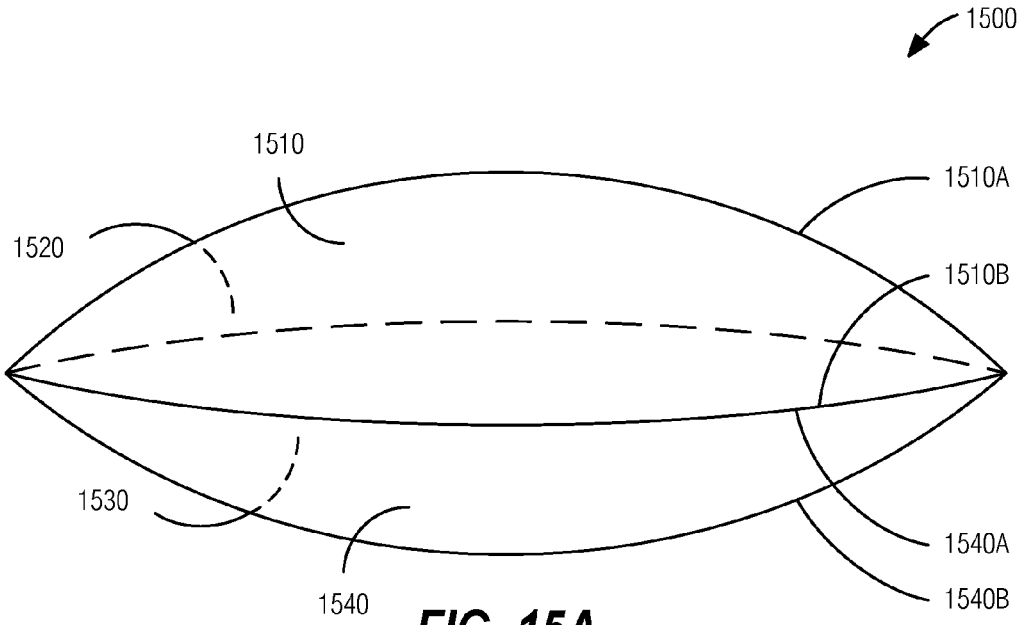
FIGS. 15A-15B are perspective views of a seventh example enhanced building block.
Figure 15B:
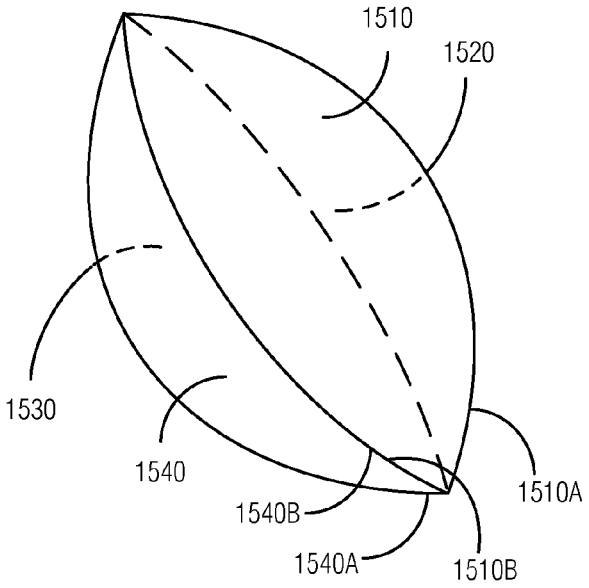

FIGS. 2A-2B are perspective views of a first example enhanced building block 200, according to an embodiment. A basic enhanced building block 200 may be formed by coupling three of the elliptical shapes 110 shown in FIG. 1 along the entire length of their edges. Each of the surfaces may be warped by coupling edges and vertices to form a three-dimensional figure, such as connecting edges 110A and 110B of surface 110 to corresponding edges of shapes 120 and 130. The side perspective view shown in FIG. 2A presents the first shape 110 to the viewer, where second surface 120 and third surface 130 are behind first surface 110. The top perspective view shown in FIG. 2B shows the first surface 110 and second surface 120, occluding the third surface 130. Additional shapes may be used, and additional surfaces may be combined to form other shapes. In an embodiment, a fourth elliptical shape may be used to form a four-sided enhanced building block that resembles a football, such as shown in FIGS. 15A-15B. In an embodiment, additional elliptical shapes may be used to form additional multi-sided enhanced building blocks.

In various embodiments, the enhanced building blocks may be transparent, may be translucent, may include a semi-transparent material comprised of a color, or may include a solid (e.g., opaque) material. One or more light emitting diodes (LEDs) 230 may be embedded within an enhanced two-dimensional surface or within an enhanced three-dimensional shape. The LEDs 230 may be bulb LEDs with two exposed contacts, may be substantially two-dimensional flexible organic light-emitting diode (OLEDs), or other types of LEDs. LEDs 230 may receive power through electrically conductive grid lines, where the grid lines may be mounted to an edge 120B, may be arranged within the enhanced two-dimensional surface, or may be arranged within an inner space of the enhanced building block. Power may be provided to the LEDs through a power storage element (e.g., capacitor, battery) or through a power-generating element (e.g., solar cell 210, piezoelectric component 240). The electrically conductive grid lines may conduct power to the LEDs 230 for educational purposes. For example, two enhanced devices may detect proximity using a magnetic or other proximity detection mechanism, and the proximity detection may convey power to the LEDs 230 to indicate that the enhanced devices have been placed in the correct arrangement. The electrically conductive grid lines may serve as contour lines for educational purposes. For example, a two-dimensional surface with a grid pattern may be used to form one or more curved enhanced surfaces, and the curved enhanced surfaces will exhibit a visual distortion of the grid pattern according to the curvature of each surface. In another example, one or more enhanced surfaces may be formed using OLEDs or liquid crystal displays (LCDs), and may display various human-readable or machine-readable information.

The enhanced building block may alter its appearance based on the presence of electrical current, an electric or magnetic field, sound vibration, or other external force. The enhanced building block may include one or more piezoelectric components 240, and this piezoelectric component 240 may convert between mechanical and electrical inputs. For example, a quartz piezoelectric element may be included at one or both of the two vertices in the enhanced building block 210, and may be used to generate power for one or more LEDs 230. The piezoelectric element 240 may be used for educational purposes. For example, two enhanced devices may detect proximity using a magnetic or other proximity detection mechanism, and the proximity detection may convey power to the piezoelectric element 240 to generate a sound to indicate that the enhanced devices have been placed in the correct arrangement. One or more mechanical or electromechanical resonant devices may be used to modify, propagate, amplify, or mitigate externally applied vibration. For example, a mechanical tuning fork may be used to amplify vibration induced in a piezoelectric element 240.

In some embodiments, using electrochemical materials, application of an electrical current may transition one or more surfaces of the enhanced building block to translucent, clouded, or colored. A solid enhanced building block may be used to conduct vibration, such as in acoustic or other applications. For example, induced mechanical vibration may be used in vibration therapy. The enhanced building block may be constructed using a conductive material for various electrical applications. For example, one or more of the faces of the enhanced building block may be comprised of silicon, where the silicon is arranged to function as a resistor, inductor, capacitor, transistor, complete microchip (e.g., integrated circuit) 220, or other electrical component. Multiple enhanced building blocks may be arranged to propagate conducted vibration. For example, a mechanical vibration may be generated by applying an electric current to a piezoelectric element 240 in a first building block, and this vibration may be conducted by the second building block and converted to an electrical impulse.

The enhanced building block may be made of a transparent material, and may be of a uniform or nonuniform thickness. The enhanced building block may include one or more photovoltaic cells (e.g., solar cells) 210, and may be used in solar power applications. For example, the cross-section of the enhanced building block may be convex or concave, and may be used as a lens in various optical applications. The enhanced building block may include various color patterns. Various additional ornamental designs may be used on each surface of the enhanced building block. Various designs may include lines comprised of magnetic tape, where information may be encoded or transferred using the magnetic tape. For example, standard magnetic tape encoders and readers may be used to record or read information encoded on a magnetic tape stripe on an exterior surface. Various designs may include lines comprised of electrically conductive materials, such as copper.

The enhanced building block may be constructed using a flexible material to allow the three faces to expand or contract.

The lines within each enhanced device may be uniformly distributed. For example, a circular enhanced template may include a series of arcs radiating from the circle center to the circle radius, where each arc is spaced apart from adjacent arcs by forty-five degrees. Enhanced devices corresponding to this circular two-dimensional enhanced template may have corresponding arc portions, and the arc portions may aid the user in arranging the enhanced devices on the template. In other embodiments, the grid lines may be irregular in shape or spacing, may be configured in a fractal pattern, or may be configured in another arrangement.

The inner space may include one or more gasses, such as noble gasses or gasses that are translucent or colored. The inner space may include one or more fluids (e.g., gasses or liquids). The fluid may be selected according to its response to heating or cooling. In another example, a fluid with a high heat capacity may store energy received from solar heating, such as in concentrated solar power applications. The fluid may be selected according to its ability to change color or light absorption. For example, a suspended particle fluid may transition from a clouded appearance to a translucent appearance in the presence of an electrical voltage. Various levels of transparency or various shades of color may be used. The use of semi-transparent materials of various colors may allow the colors to be combined depending on orientation. For example, if the device is held so a blue face is superimposed on a yellow face, the object may appear green. Similarly, multiple enhanced building blocks may be combined to yield various colors. Multiple enhanced building blocks may be combined to form the appearance of various platonic solids, where the platonic solid appearance may depend on each enhanced building block's specific periodicities of motion and wave positions in time as indicated by the direction of particular intersecting linear projections. For example, the vertices of multiple enhanced building blocks may be combined to form a larger enhanced device.

Figure 3A:
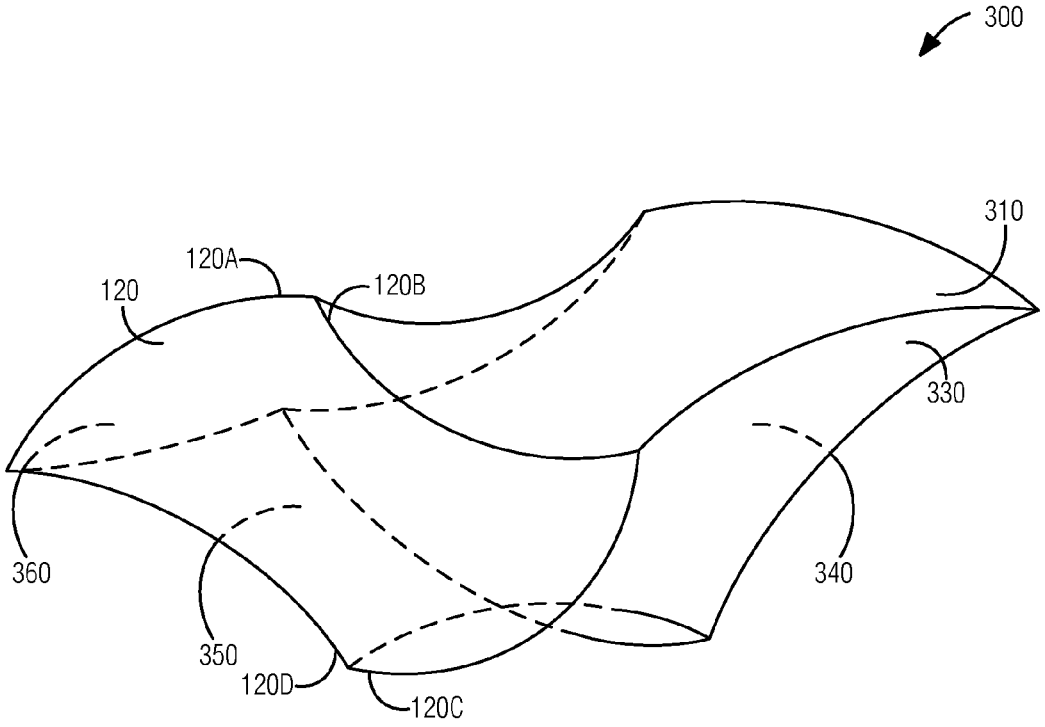
FIGS. 3A-3B are perspective views of a second example enhanced building block.
Figure 3B:
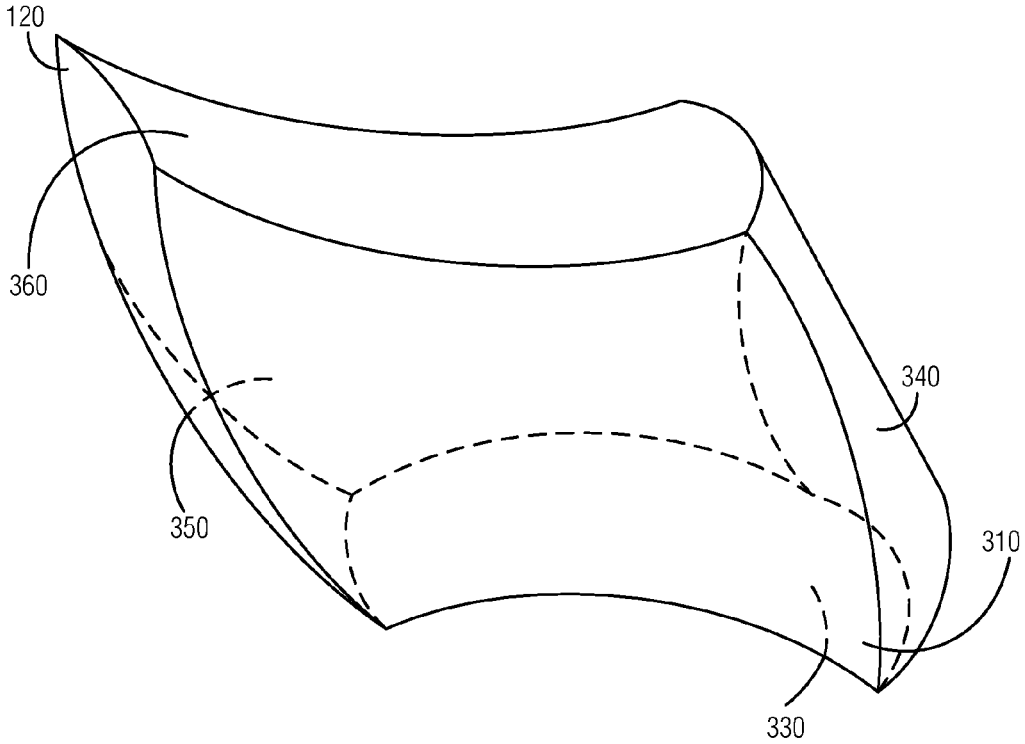

FIGS. 3A-3B are perspective views of a second example enhanced building block 300, according to an embodiment. Using the four-sided shapes 120 shown in FIG. 1, a basic enhanced building block 300 may be formed from six surfaces 310, 120, 330, 340, 350, and 360 coupled along the entire length of their edges. The six surfaces 310, 120, 330, 340, 350, and 360 may be arranged analogous to the six surfaces of a cube, though each four-sided shape 120 may be curved (e.g. warped) to allow its edges to meet the edges of each adjacent surface. The side perspective view shown in FIG. 3A presents the first, second, and third surfaces 310, 120, and 330 to the viewer, where fourth, fifth, and sixth surfaces 340, 350, and 360 are occluded by the enhanced building block 300. Surface 310 may be rotated toward the viewer to yield the top perspective view shown in FIG. 3B. The top perspective view shown in FIG. 3B presents surfaces 310, 120, 340, and 360 to the viewer, where surfaces 330 and 350 are occluded by the enhanced building block 300. Additional shapes may be used, and additional surfaces may be combined to form other shapes.

Figure 4:
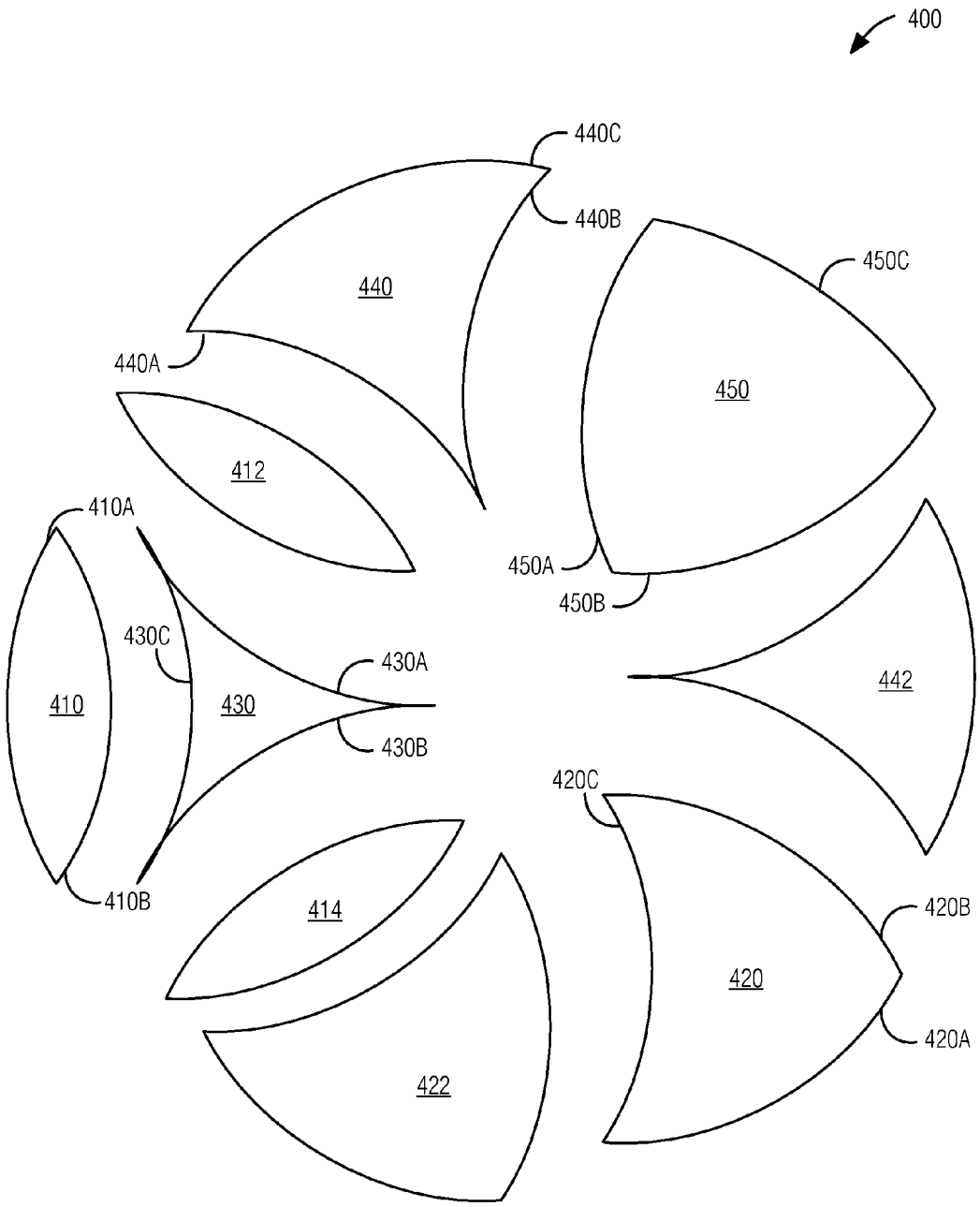
FIG. 4 is a front view of a second set of shapes that may be used to form a second enhanced building block.

FIG. 4 is a front view of a second set of shapes 400 that may be used to form a second enhanced building block, according to an embodiment. In an embodiment, a circular shape is separated using a plurality of arcs to form one or more shapes. Two or more of these shapes may be mutually congruent, such as 410-414 or 420-422. Other shapes may be mutually distinct, including 430, 440, or 450. The arcs used to form various shapes may be of integer multiple arc lengths. For example, all of the arcs shown in FIG. 4 may be congruent circular arcs, may be described by a constant radius consistent with a circle, may be described by major and minor radii consistent with an ellipse, or may be described by another shape. In addition to forming one or more three-dimensional enhanced devices using a combination of these two-dimensional shapes, these shapes may be formed from a tetrahedral building block, such as is shown in FIG. 5.

Figure 5:
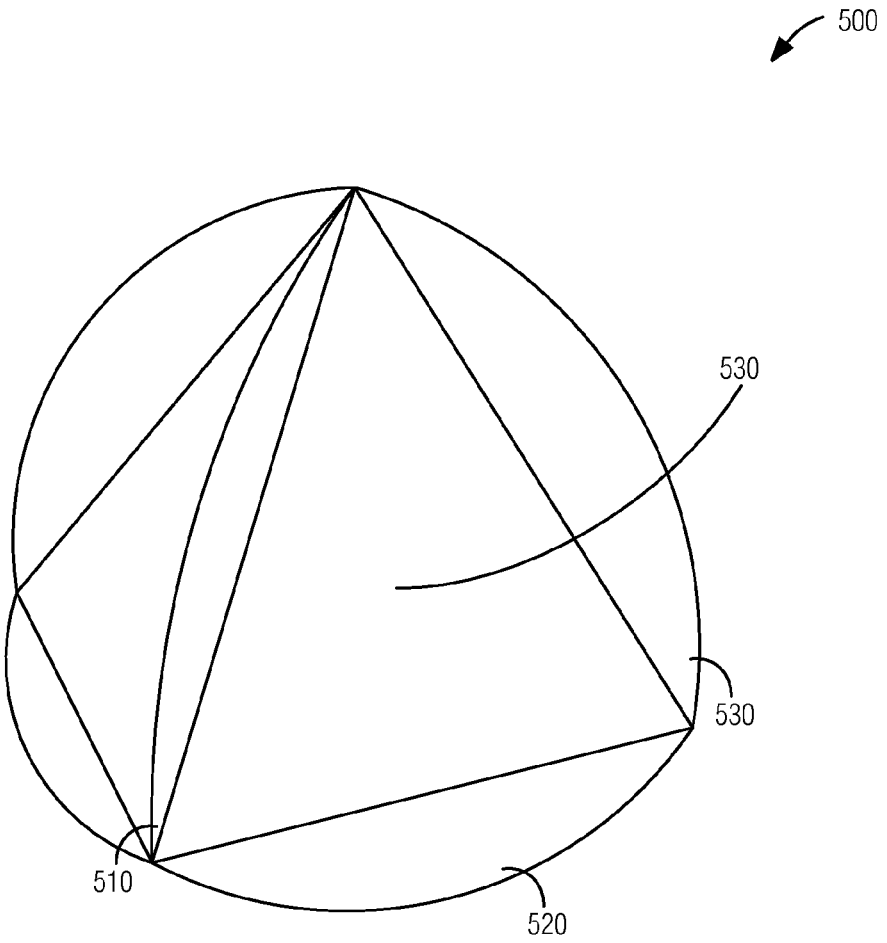
FIG. 5 is a perspective view of a tetrahedral building block used to form one or more enhanced building blocks.

FIG. 5 is a perspective view of a tetrahedral building block 500 used to form one or more enhanced building blocks. As described in the Related Applications referenced above, the tetrahedral device may include a tetrahedral inner volume with triangular surfaces 530 and elliptical flanges 510-530. The triangular surfaces 530 may be formed using scalene, isosceles, or equilateral triangles, where each equilateral triangle interior angle is one hundred and twenty degrees. Various devices may be created by adding or removing various shapes or by expanding or contracting the inner tetrahedral volume, such as is shown in FIG. 6.

Figure 6:
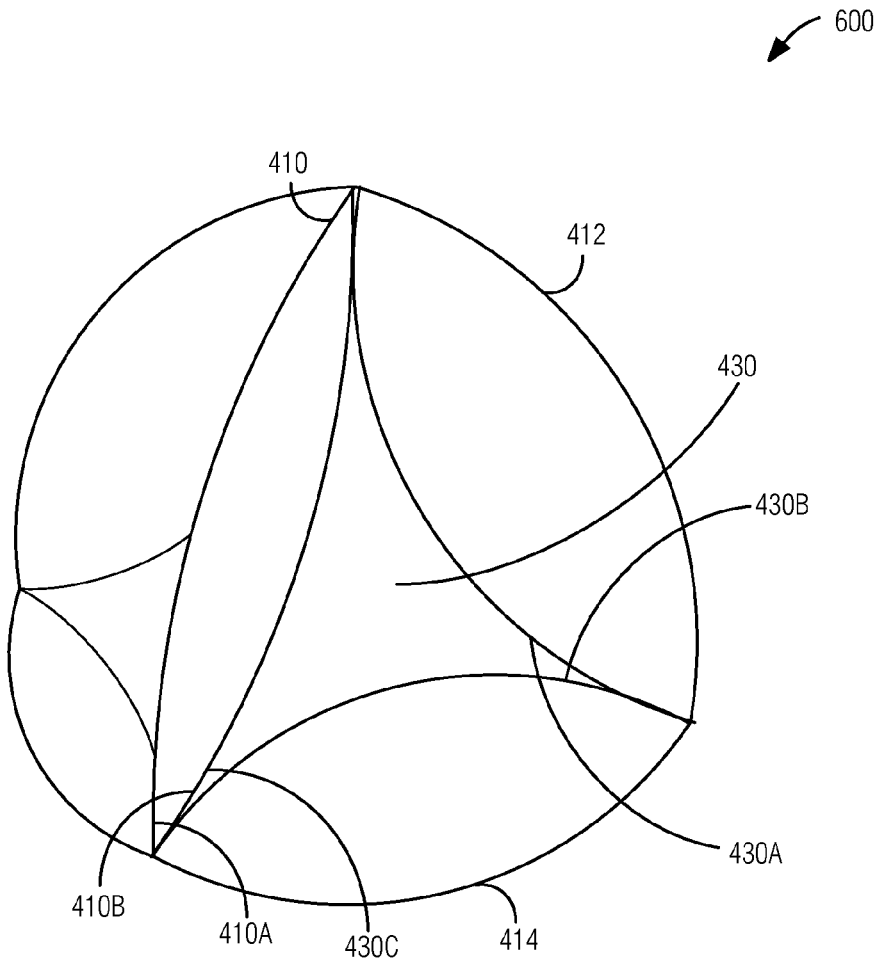
FIG. 6 is a perspective view of a third example enhanced building block formed from a tetrahedral building block.

FIG. 6 is a perspective view of a third example enhanced building block 600 formed from a third tetrahedral building block, according to an embodiment. An enhanced device may be formed by contracting the inner volume of a tetrahedral device. For example, by contracting the tetrahedral inner volume of a tetrahedral device, various surfaces shown in FIG. 4 may be created, such as 410-414 and 430. The three contracted triangular faces 430 may define an inner volume, where edges of shapes 410-414 may share an entire length of edge 410A-410C to form elliptical flanges. Each flange may be constructed using a semi-flexible or inflexible material and connected at each triangle contracted triangular face using a hinge, where the hinge may be constructed using a flexible material or a mechanical hinge. The flanges may be collapsed (e.g., closed) toward the inner volume of the enhanced building block, and may become flush (e.g., coplanar) with the respective contracted triangular surfaces. A fluid within the inner volume may expand or contract and cause one or more flanges to open or close.

The flanges may be collapsed or opened fully or partially through various methods. The flanges may be collapsed or opened by various active mechanical or electromechanical devices. These devices may include hydraulic actuators, servos, or other mechanical or electromechanical means. For example, the flanges or inner tetrahedral surfaces may contain magnetic or electromagnetic material, and one or more electromagnets may be energized selectively to collapse or open one or more flanges. An electromagnetic field may be used to cause movement of one or more flanges, or may be used to arrange two or more enhanced devices in a predetermined configuration. In embodiments where the flanges define an inner volume, the flanges may be collapsed or opened by heating or cooling a fluid (e.g., increasing or decreasing molecular vibration) contained within the enhanced. For example, the fluid may be heated using solar energy, and the expanding fluid may fill the flanges and cause them to open. The flanges may be collapsed or opened by various passive methods, such as collapsing and opening opposing flanges alternatingly in response to a fluid. For example, a moving fluid such as wind may open a flange and cause the enhanced device to rotate around its axis of symmetry, and as the flange rotates into the wind, the wind may collapse that flange.

In some embodiments, the contracted triangular surfaces may also be collapsed or removed to allow nesting (e.g., stacking) of two or more enhanced building blocks. Two or more enhanced building blocks may be nested, and may be connected at one or more connection points via mechanical, magnetic, or by other means. For example, flange 410 may be a magnetic flange or may include a magnetic edge 410B, and flange 410 may adhere to a ferromagnetic magnetic inner volume 430 on edge 430C. Multiple enhanced devices may be nested on one or more of the vertices of the contracted triangular faces. For example, multiple devices may be nested on the three bottom vertices to form a tripod configuration, and multiple devices may be nested on the top vertex to form a vertical column. In an additional example, a second nested tripod configuration could be arranged on the vertical column, where each of the three tripod legs serves as a counterbalance for the other two tripod legs. Enhanced devices may be designed asymmetrically so that a series of enhanced building blocks may be connected to form a circle, polygon, or other shape. Any combination of nested enhanced devices may be used to form larger structures. Nested enhanced structures may be expanded or reinforced by adding additional shapes, such as those shown in FIG. 1, 4, or 7.

Figure 7:
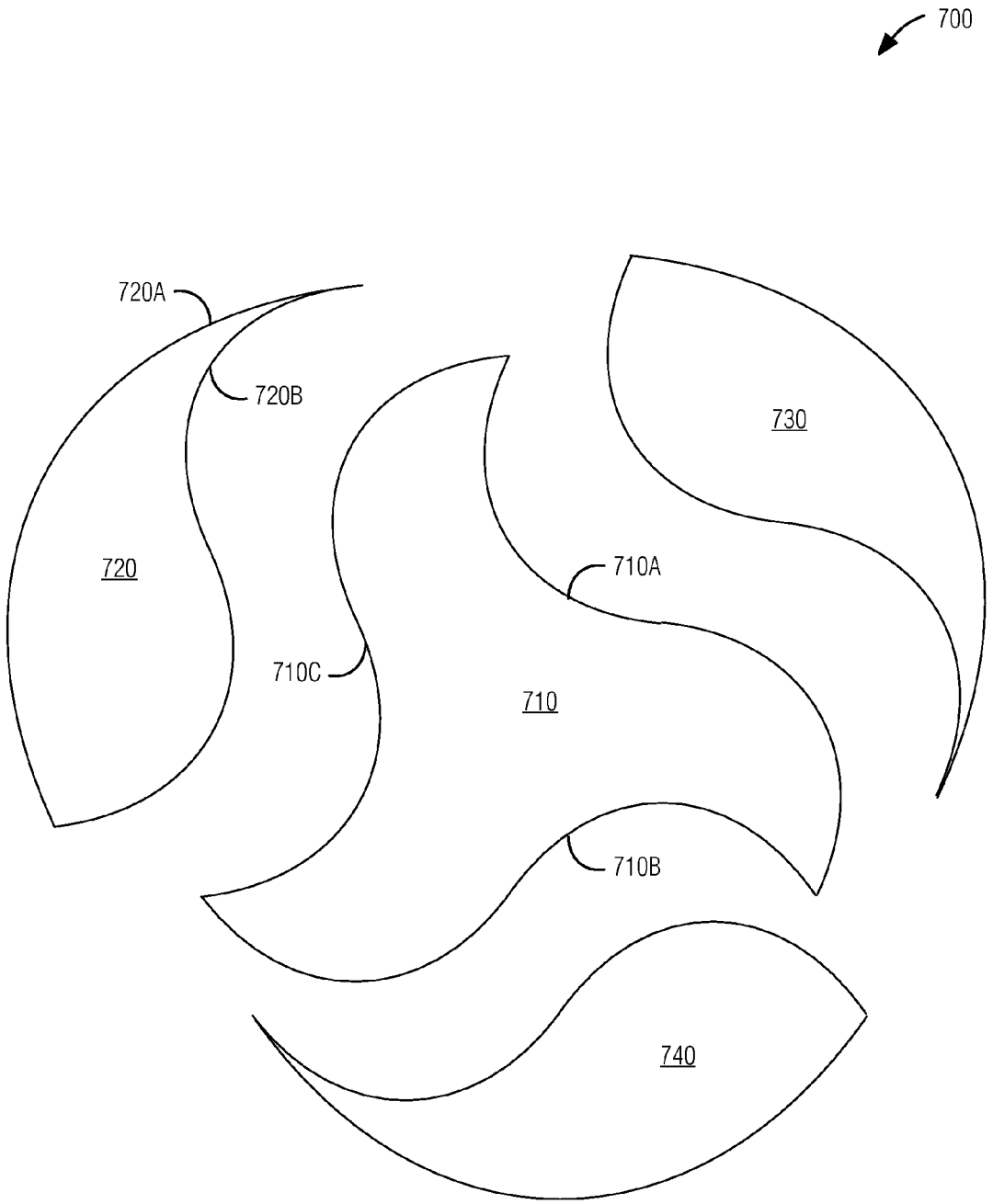
FIG. 7 is a front view of a third set of shapes that may be used to form a third enhanced building block.
Figure 11:
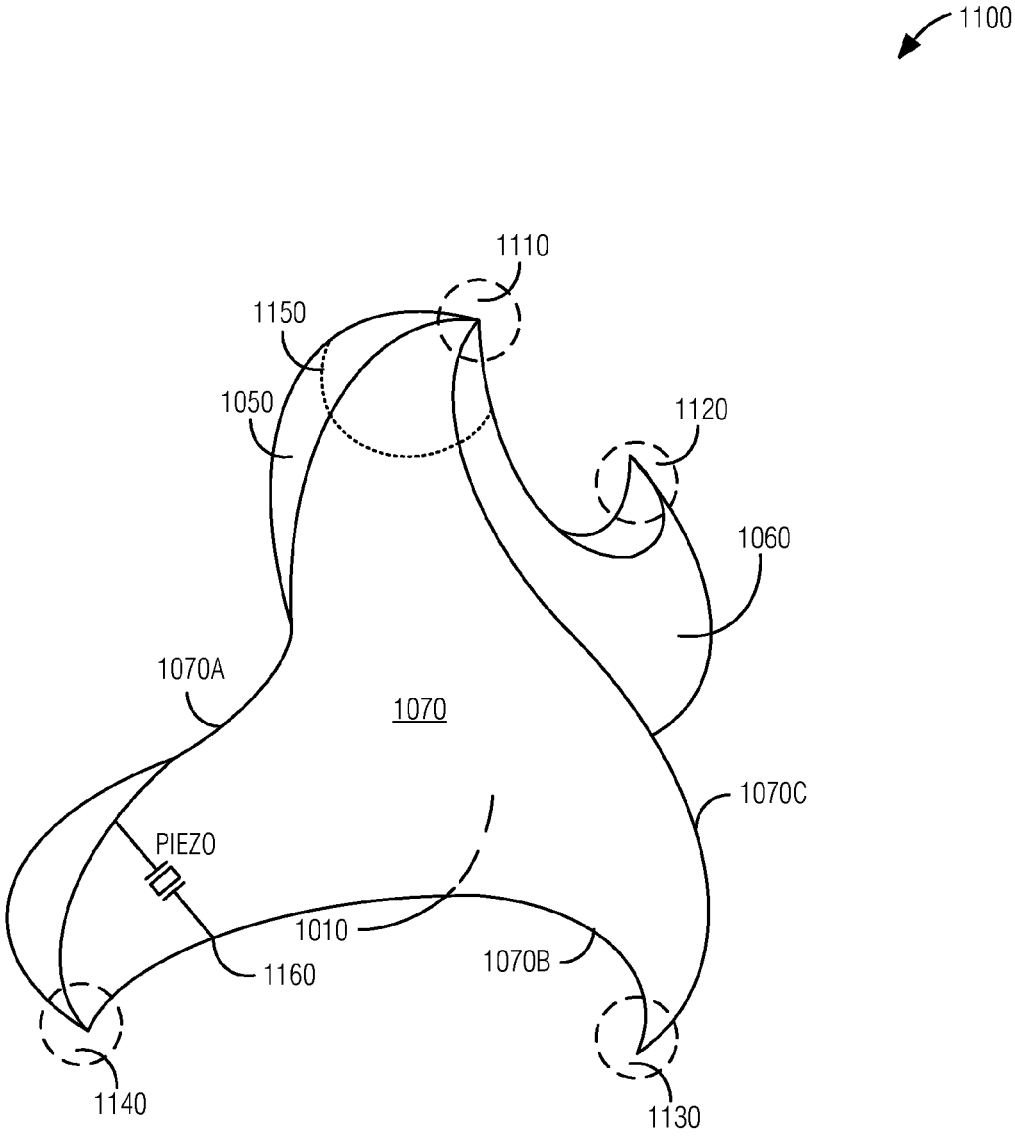
FIG. 11 is a front view of an assembled curvilinear tetrahedral enhanced building block.
Figure 21A:
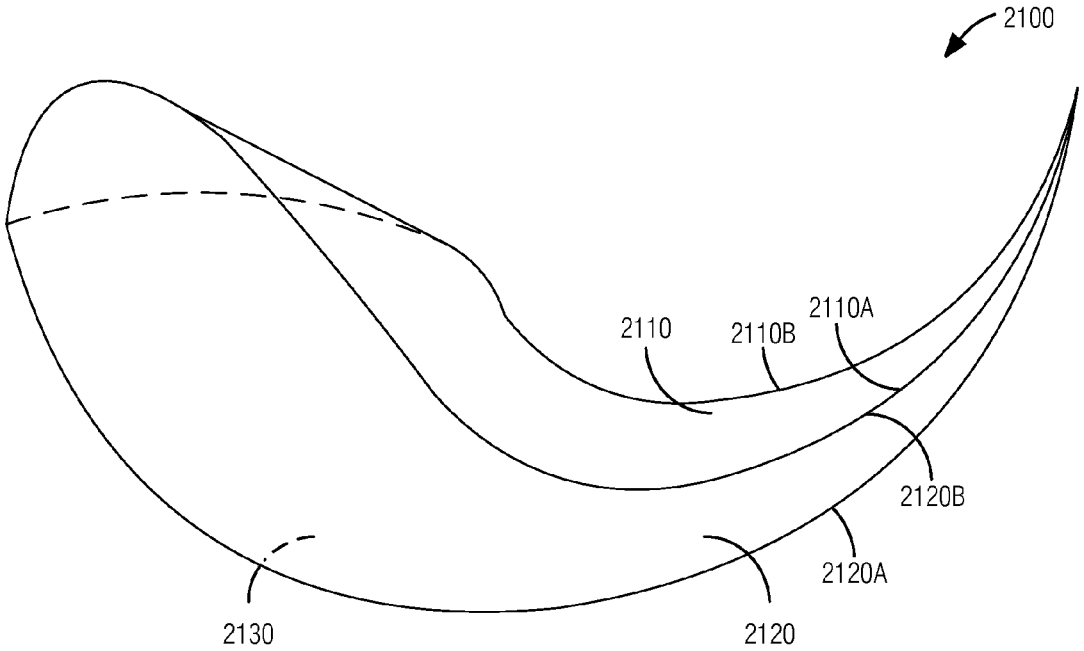
FIGS. 21A-21B are perspective views of an eleventh example enhanced building block.
Figure 21B:
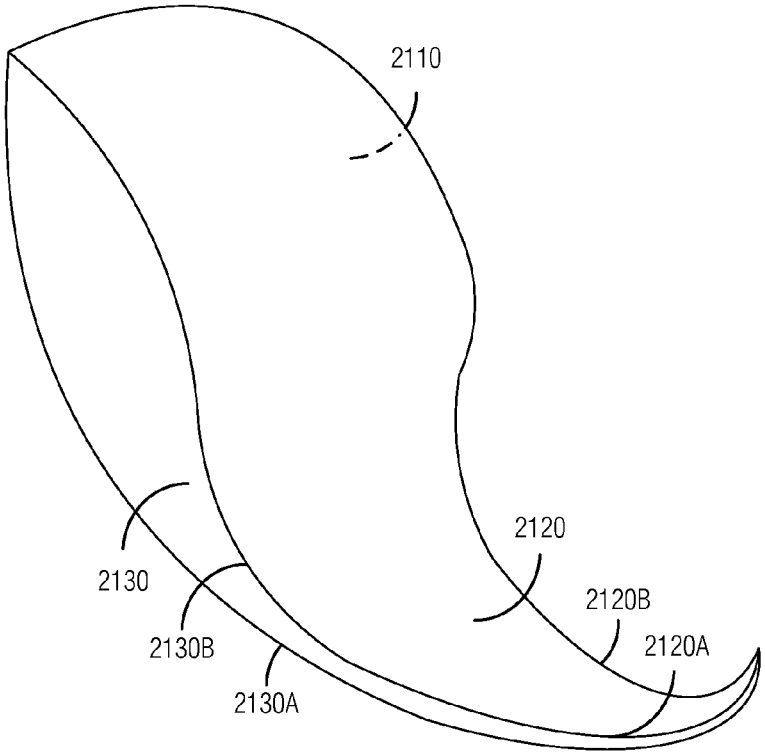

FIG. 7 is a front view of a third set of shapes 700 that may be used to form a third enhanced building block, according to an embodiment. A fan shape 710 may be formed by removing three curved shapes 720A-720C. Four fan shapes may be combined to form a three-dimensional enhanced building block, such as is shown in FIG. 11. The three curved shapes 720A-720C may be combined to form a three-dimensional enhanced building block, such as is shown in FIGS. 21A-21B.

Figure 8:
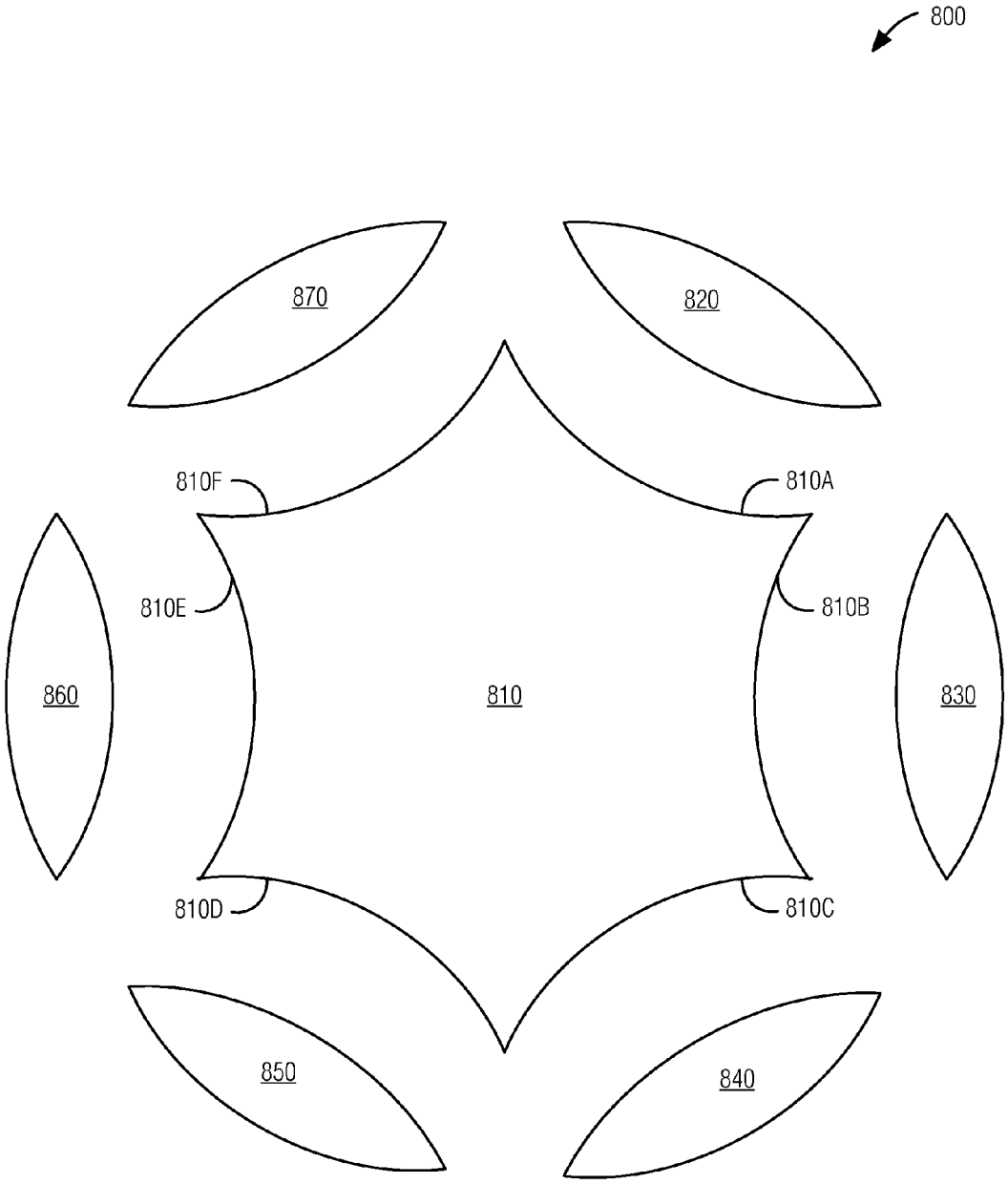
FIG. 8 is a front view of a fourth set of shapes that may be used to form a fourth enhanced building block.

FIG. 8 is a front view of a fourth set of shapes 800 that may be used to form a fourth enhanced building block, according to an embodiment. In an embodiment, a circular shape is separated using a plurality of arcs to form seven shapes, including a central six-pointed shape 810. The arcs may form two or more mutually congruent shapes, such as 820A-820F. Four of the two-dimensional six-pointed shapes 810 may be combined with other two-dimensional shapes to form one or more three-dimensional enhanced devices, such as is shown in FIG. 9.

Figure 9:
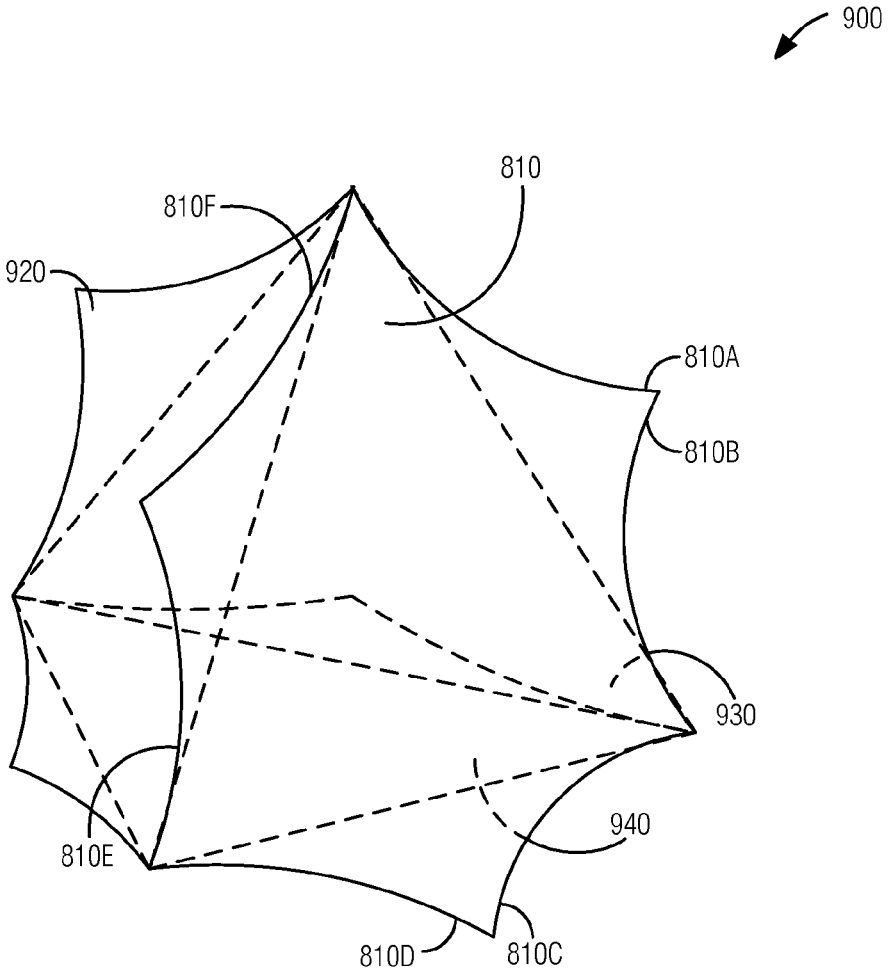
FIG. 9 is a perspective view of a fourth example enhanced building block.

FIG. 9 is a perspective view of a fourth example enhanced building block 900, according to an embodiment. Using four of the six-pointed shapes 810, a basic enhanced building block 900 may be formed using a first surface 810, a second surface 920, a third surface 930, and a fourth surface 940 coupled along the entire length of their edges. The perspective view shown in FIG. 9 presents the first and second surfaces 810 and 920 to the viewer, where the third surface 930 is behind the first and second surfaces 810 and 920, and where the fourth surface 940 is on the bottom of the enhanced building block 900. As shown by the straight dotted lines in FIG. 9, the inner space in this fourth example enhanced building block 900 resembles the tetrahedral inner volume of a tetrahedral device. Though FIG. 9 shows each surface of the enhanced building block 900 using a six-pointed shape 810 with curved edges, a six-pointed shape with six straight edges may be used, such as a regular (e.g., equiangular and equilateral) hexagon. Additional embodiments using regular polygons may have a number of surfaces that are integer multiples of three, including the hexagon with sixty degree interior angles, a twelve-sided dodecahedron with thirty degree interior angles, a twenty-four sided icosikaitetragon with fifteen degree interior angles, et cetera. Different three-dimensional enhanced building blocks may be formed using any three or more two-dimensional shapes, including any combination of arbitrary shapes or regular or irregular close-chain polygons.

In some embodiments, multiple enhanced building blocks may be connected to form a closed chain polygon (e.g., triangle, square, pentagon, etc.). The building blocks may be connected to each other by magnetic means, by soldering, or by other means. Alternatively, the enhanced building blocks may be connected to a center hub using one or more spokes per enhanced building block. The connected building blocks may be configured to rotate around the center hub, such as in response to a fluid flow (e.g., gas or liquid). For example, the connected building blocks may be used in a turbine configuration, where each enhanced building block is configured to spill and catch air depending on the angles of the flanges and orientations of the enhanced devices to cause the connected enhanced building blocks to rotate. As another example, the connected building blocks may be used in a water wheel configuration, where water may contact outer flanges and cause the connected building blocks to rotate. The building blocks may be adjusted to change the angular velocity, rotational direction, or other response of the connected building blocks to movement of a fluid across the surface of the enhanced devices. Adjustments may include collapsing or opening individual flanges, or extending or retracting the respective building blocks relative to the hub. In embodiments where the building blocks are formed from or include a framework comprised of a conductive material, the connected building blocks may be arranged to form an antenna, such as for terrestrial or satellite communication. The connected building blocks may be used to conduct vibration, such as in acoustic applications, vibration therapy, or other applications. Other hydrodynamic or aerodynamic applications may be used. In addition to these macroscopic applications for a single or multiple enhanced building blocks, enhanced building blocks may be used in various microscopic applications such as nanotechnology. For example, multiple microscopic enhanced building blocks may be configured to arrange themselves in a predefined structure in the presence of a magnetic field. Similarly, multiple microscopic enhanced building blocks may be permanently arranged in a microscopic structure with predetermined properties, such as a resistor, inductor, capacitor, transistor, complete microchip, or other electrical component.

Figure 10A:
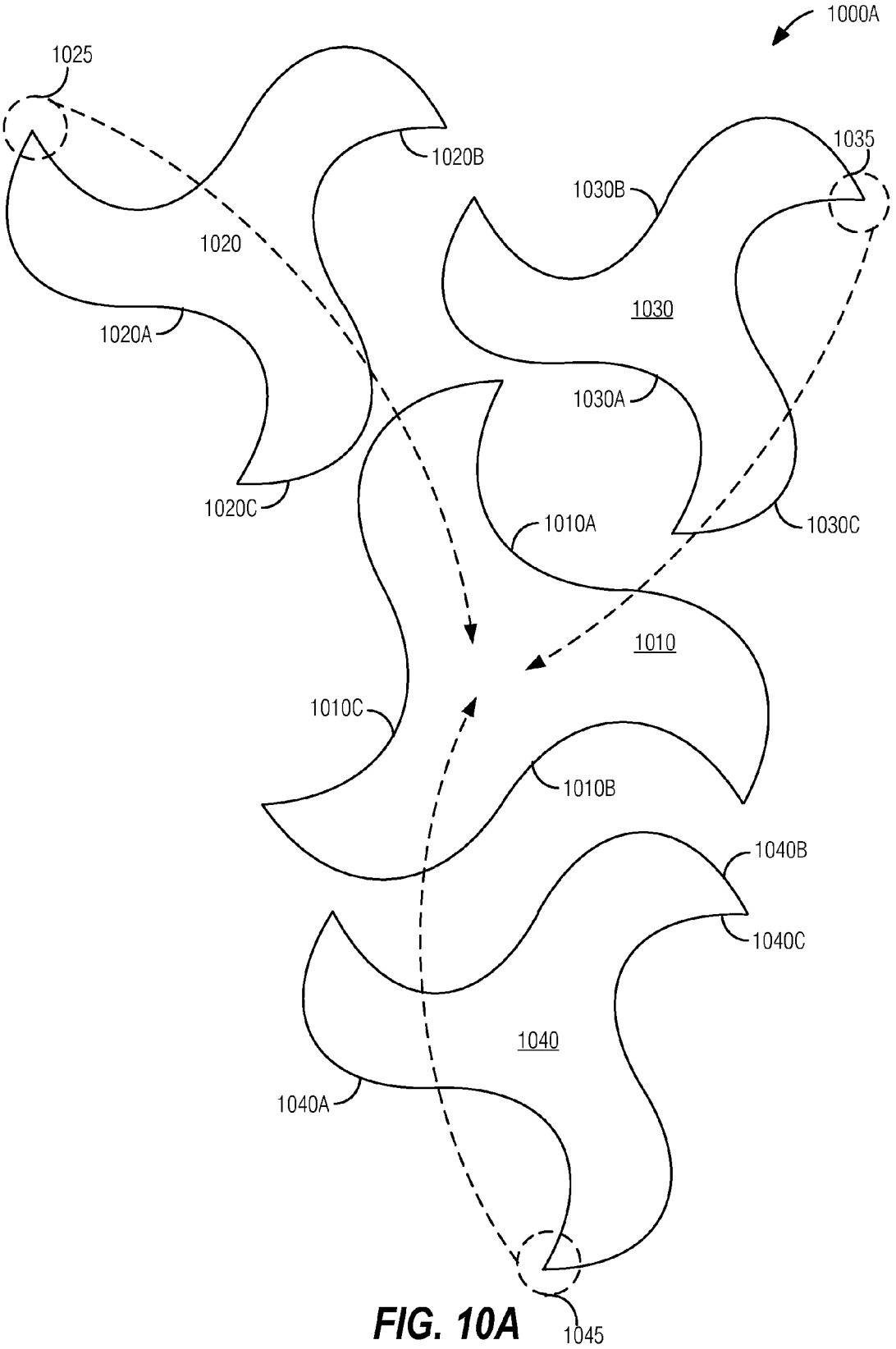
FIGS. 10A and 10B are front views of disassembled fifth example enhanced building block.
Figure 10B:
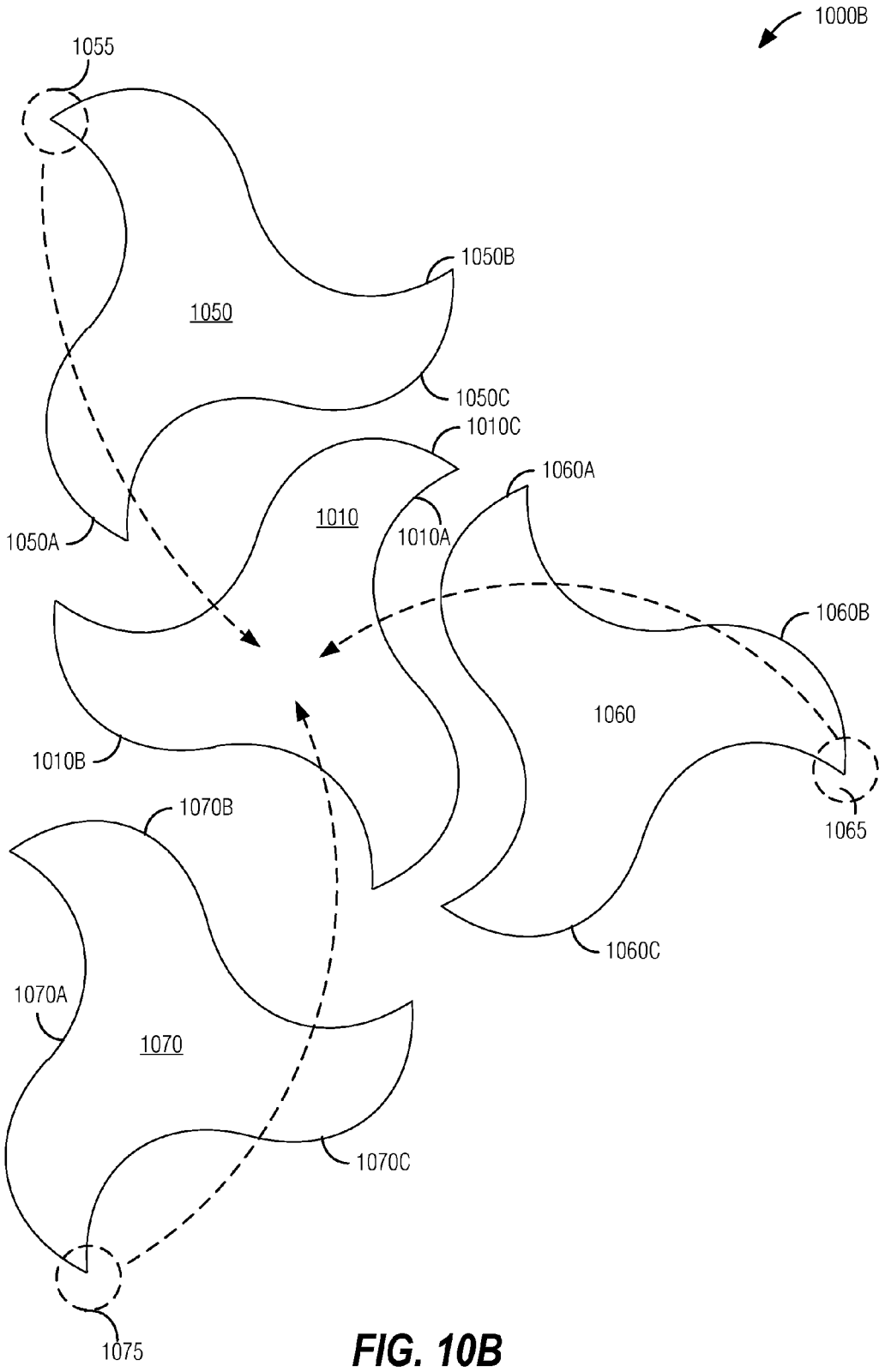

FIGS. 10A and 10B are front views of disassembled fifth example enhanced building blocks 1000A and 1000B, according to an embodiment. Disassembled fifth example enhanced building block 1000A may be formed from four fan-shaped devices 1010, 1020, 1030, and 1040 coupled along the entire length of their edges. Similarly, 1000B may be formed from four fan-shaped devices 1020, 1050, 1060, and 1070 coupled along the entire length of their edges. Each fan-shaped device may be formed from a circular template, such as the fan-shaped device 710 shown in FIG. 7. FIG. 10A is a front view of four identical fan-shaped devices 1010, 1020, 1030, and 1040, where each fan-shaped device includes three sigmoid (S-shaped) surfaces 1010A-1010C, 1020A-1020C, 1030A-1030C, and 1040C-1040C. In contrast with FIG. 10A, FIG. 10B includes a sigmoid group and a reverse-sigmoid group. The sigmoid group includes two fan-shaped devices 1010 and 1060 that each include three sigmoid edges 1010A-1010C and 1060A-1060C. Similarly, the reverse-sigmoid groups includes two fan-shaped devices 1050 and 1070 that each include three reverse-sigmoid edges 1050A-1050C and 1070A-1070C.

Various edges may be coupled using adhesive, a chemical fixative, a magnetic coupling, or coupling through other means to form a three-dimensional building block. In an example, the two sigmoid fan-shaped devices 1010 and 1060 may be coupled along the entirety of an edge, such as coupling (e.g., attaching) the entire length of edge 1010A to the entire length of edge 1060A. The two sigmoid fan-shaped devices 1010 and 1060 may be coupled to form an acute angle with respect to each other, where the coupling of edges 1010A and 1060A cause a warping (e.g., deformation, curving) of the coupled edges and of the devices 1010 and 1060. Similarly, the two reverse-sigmoid fan-shaped devices 1050 and 1070 may be coupled along the entirety of an edge, such as coupling the entire length of edge 1050A to the entire length of edge 1070A. The two reverse-sigmoid fan-shaped devices 1050 and 1070 may be coupled to form an acute angle with respect to each other, where the coupling of edges 1050A and 1070A cause a warping of the coupled edges and of the devices 1050 and 1070. The coupled pair of sigmoid fan-shaped devices 1010 and 1060 may be coupled to the coupled pair of reverse-sigmoid fan-shaped devices 1050 and 1070 to form a curvilinear tetrahedral enhanced building block as shown in FIG. 11. In another example, the curvilinear tetrahedral enhanced building block may be formed from the fan-shaped devices shown in FIG. 10B by lifting the distal corners 1055, 1065, and 1075 toward the viewer and by connecting adjacent edges.

FIG. 11 is a front view of an assembled curvilinear tetrahedral enhanced building block 1100, according to an embodiment. The curvilinear tetrahedral enhanced building block 1100 may be referred to as a "Whirl Maker" device. The curvilinear tetrahedral enhanced building block 1100 may be assembled using four fan-shaped devices 1010, 1050, 1060, and 1070. The four fan-shaped devices 1010, 1050, 1060, and 1070 may be rigid, semi-rigid, or flexible to allow or conduct vibration or other mechanical displacements. The resulting curvilinear tetrahedral enhanced building block 1100 may be sealed to include an inert gas or other substance, where the substance may be selected based on conductivity, buoyancy, compressibility, or other substance characteristics.

The resulting shape includes four curved corners 1110, 1120, 1130, and 1140. Each of the curved corners 1110, 1120, 1130, and 1140 may be rigid, semi-rigid, or flexible, and maybe configured to rotate around an axis. For example, corner 1100 may include a seam 1150 that allows rotation in a circular motion. The rotation may allow corner 1110 to be reoriented in a specific direction, or may allow corner 1110 to be rotated continually to generate a force against a surrounding fluid. This corner rotation force may be used to reorient the curvilinear tetrahedral enhanced building block 1100 within a fluid medium, such as within a viscous liquid. Each of the curved corners 1110, 1120, 1130, and 1140 may induce motion independently, and the induced motion may be coordinated to cause the curvilinear tetrahedral enhanced building block 1100 to move within a fluid medium in a predetermined direction. For example, the curvilinear tetrahedral enhanced building block 1100 may be immersed in a fluid medium within a tetrahedral building block 500, and motion induced by the curvilinear tetrahedral enhanced building block 1100 may enable a rotation of the curvilinear tetrahedral enhanced building block 1100 relative to the tetrahedral building block 500.

The curvilinear tetrahedral enhanced building block 1100 may include one or more conductive elements. The conductive elements may be used to receive or generate an electric signal. For example, the curvilinear tetrahedral enhanced building block 1100 may be placed in a dielectric fluid, and conductive elements on the surface of the curvilinear tetrahedral enhanced building block 1100 may be used to send or receive signals through the dielectric fluid. The conductive elements may be used to convey or generate an electric or magnetic field. For example, electromagnetic material may be included within or on the surface of the curvilinear tetrahedral enhanced building block 1100. The generation of an electric or magnetic field may cause surrounding fluid or particles to move in a direction determined by the field, such as using electrohydrodynamic or magnetohydrodynamic means. For example, an electrostatic field may be generated within a dielectric fluid, and the electrostatic field may cause electrohydrodynamic motion within the fluid. Alternatively, a dielectric fluid may be electrified, and a magnetic field may be used to cause magnetohydrodynamic motion within the fluid. The fluid motion may be induced independently by each of the curved corners 1110, 1120, 1130, and 1140, and the induced motion may be coordinated to cause the curvilinear tetrahedral enhanced building block 1100 to move within a fluid medium in a selected direction, around a selected axis of rotation, or both.

One or more resonant members may be used within the curvilinear tetrahedral enhanced building block 1100 to sustain or enhance the fluid propulsion. For example, a piezoelectric element 1160 may convert received mechanical vibration into an electric charge, and the electric charge may be used to control or power the generation of an electric field. A piezoelectric element 1160 may also be used to convert electrical energy into vibration, and the vibration may be used to induce motion in a surrounding fluid medium. For example, the timing of the positive and negative vibratory displacement of a portion of the curvilinear tetrahedral enhanced building block 1100 may be selected to induce motion in the surrounding fluid. One or more directional flanges may be used to enhance the force of the positive displacement while decreasing the effect of the negative displacement, such as one or more retractable fins that allow fluid flow in one direction but generate drag in the opposite direction. One or more of the four fan-shaped devices 1010, 1050, 1060, and 1070 may be deformed passively or actively to generate lift or drag across the surface. For example, when directing fluid motion in the direction of one fan-shaped device 1010 (i.e., toward the viewer in FIG. 11), the three other fan-shaped devices 1050, 1060, and 1070 may be distorted to enhance laminar fluid flow and reduce turbulent fluid flow.

Figure 12:
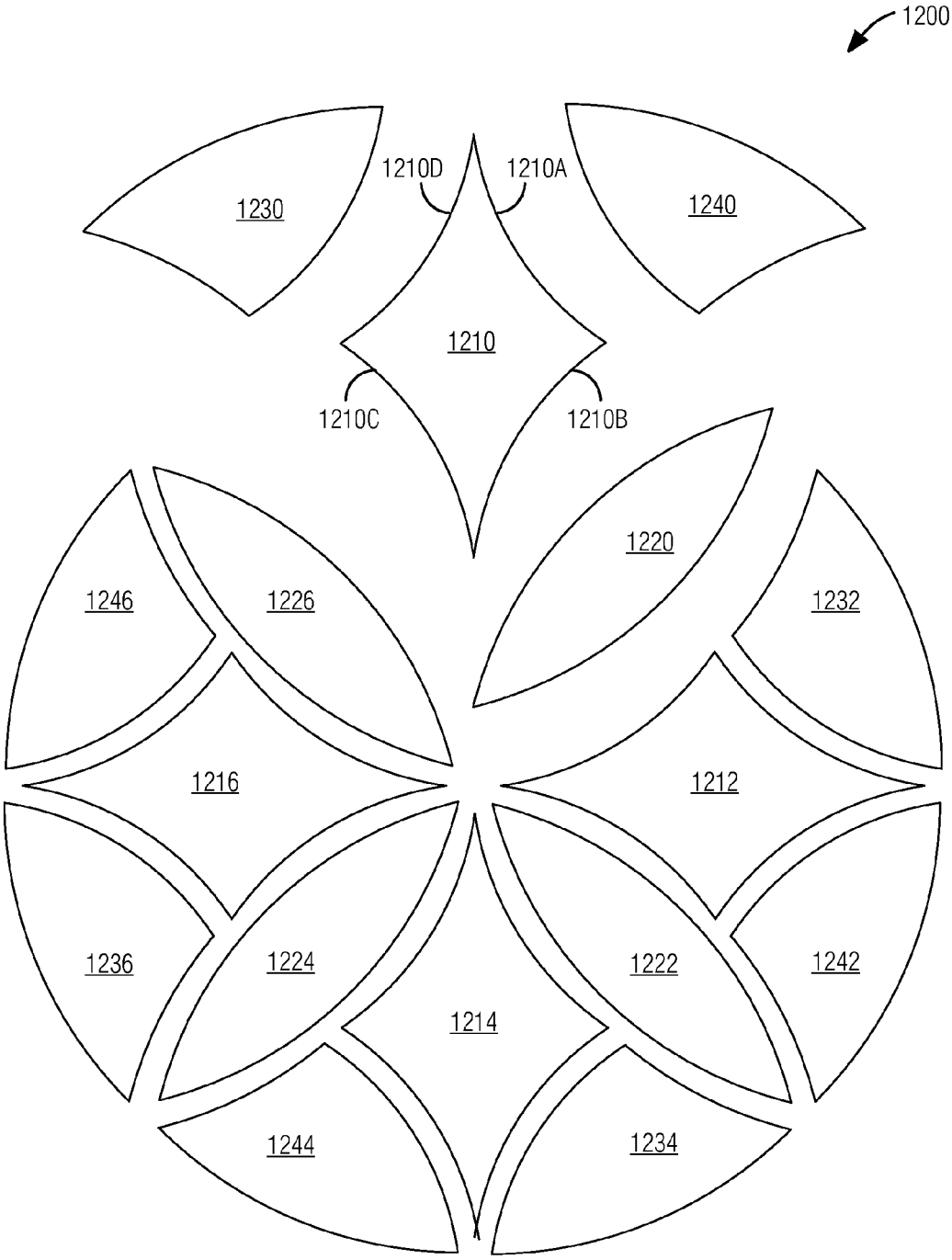
FIG. 12 is a front view of a fifth set of shapes that may be used to form an enhanced building block.

FIG. 12 is a front view of a fifth set of shapes 1200 that may be used to form an enhanced building block, according to an embodiment. In an embodiment, a circular shape is separated using a plurality of arcs to form multiple examples of four shapes. The arcs may form four mutually congruent, four-pointed shapes, such as 1210-1216. Two of the arcs may form four mutually congruent, two-pointed ellipsoid shapes, such as 1220-1226. Four mutually congruent, three-sided shapes may be formed, such as 1230-1236. Similarly, four mutually congruent, three-sided shapes may be formed, such as 1240-1246. One or more of these two-dimensional shapes may be combined with other two-dimensional shapes to form one or more three-dimensional enhanced devices, such as using six of the four-pointed shapes 1210 as shown in FIGS. 13A-13B.

Figure 13A:
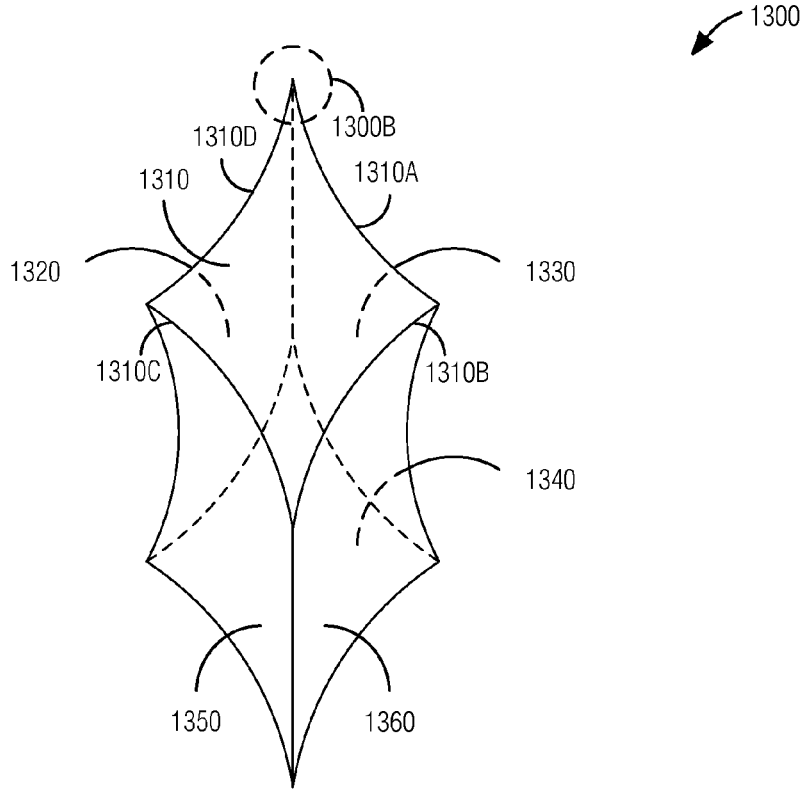
FIGS. 13A-13B are perspective views of a sixth example enhanced building block.
Figure 13B:
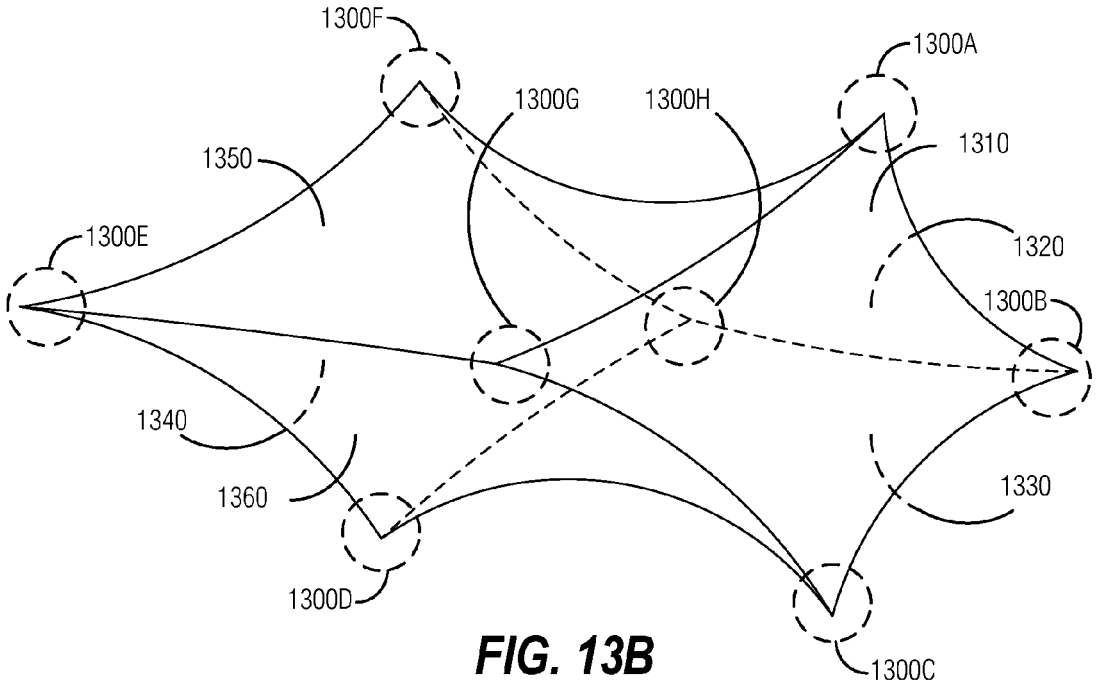

FIGS. 13A-13B are perspective views of a sixth example enhanced building block 1300, according to an embodiment. Using six of the four-sided shapes shown in FIG. 12 coupled along the entire length of their edges, a basic enhanced building block 1300 may be formed. The six surfaces may be arranged analogous to the six surfaces of a cube, though each four-sided shape may be curved to allow its edges to meet the edges of each adjacent surface. For example, edge 1310A may meet surface 1330, edge 1310B may meet surface 1340, edge 1310C may meet surface 1350, and edge 1310D may meet surface 1320. The side perspective view shown in FIG. 13A presents the first, second, and third surfaces to the viewer, where fourth, fifth, and sixth surfaces are occluded by the enhanced building block 1300. Surfaces may meet at vertex 1300B, and the vertex 1300B may be rotated clockwise to yield the top perspective view shown in FIG. 13B. The top perspective view shown in FIG. 13B presents three surfaces 1310, 1350, and 1360 to the viewer, where the remaining surfaces are occluded by the enhanced building block 1300. Additional shapes may be used, and additional surfaces may be combined to form other shapes. Multiple sixth example enhanced building blocks 1300 may be combined on various vertices 1300A-1300F to form an enhanced building block combination, such as is shown in FIGS. 14A-14B.

Figure 14A:
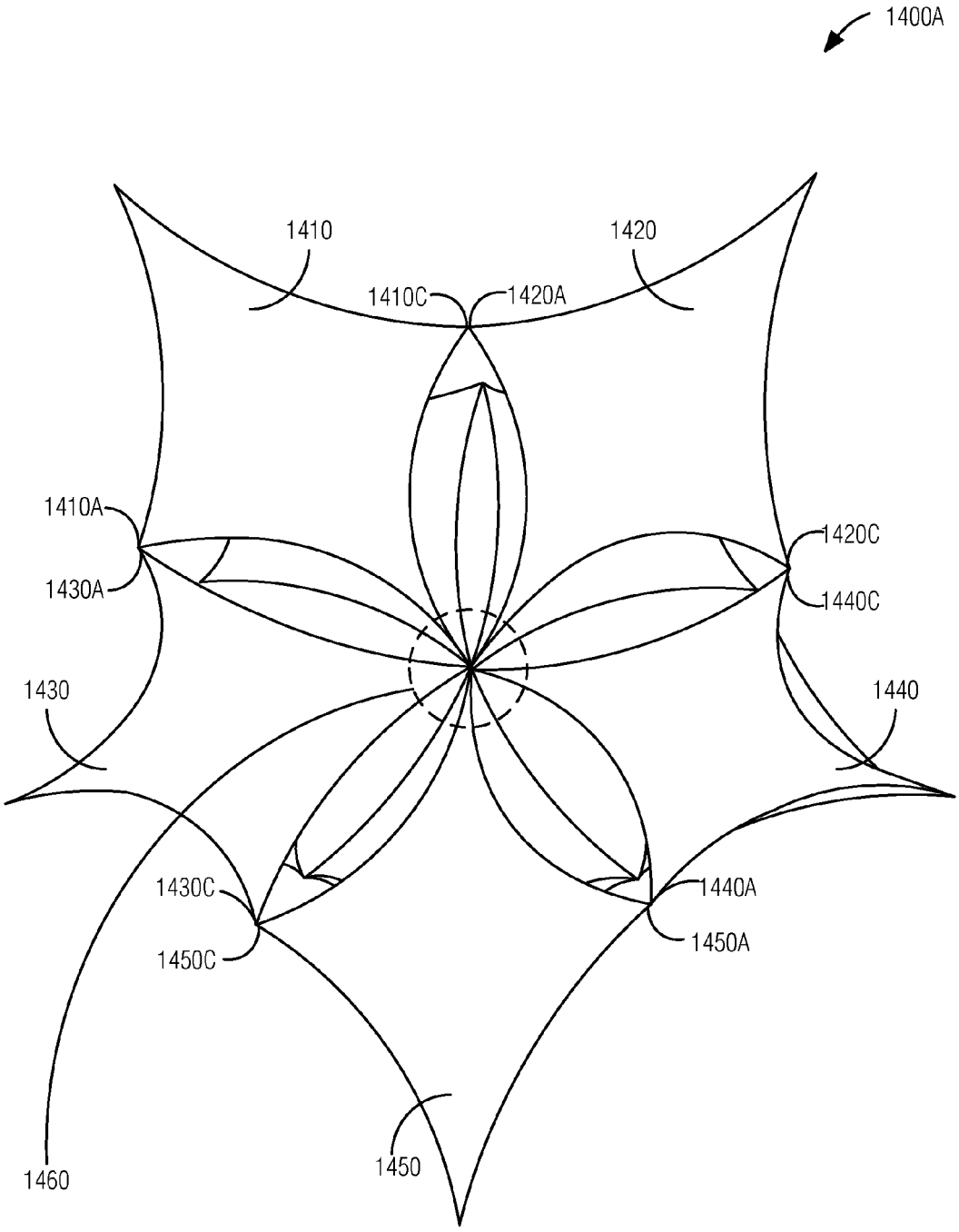
FIGS. 14A-14B are views of an enhanced building block combination.
Figure 14B:
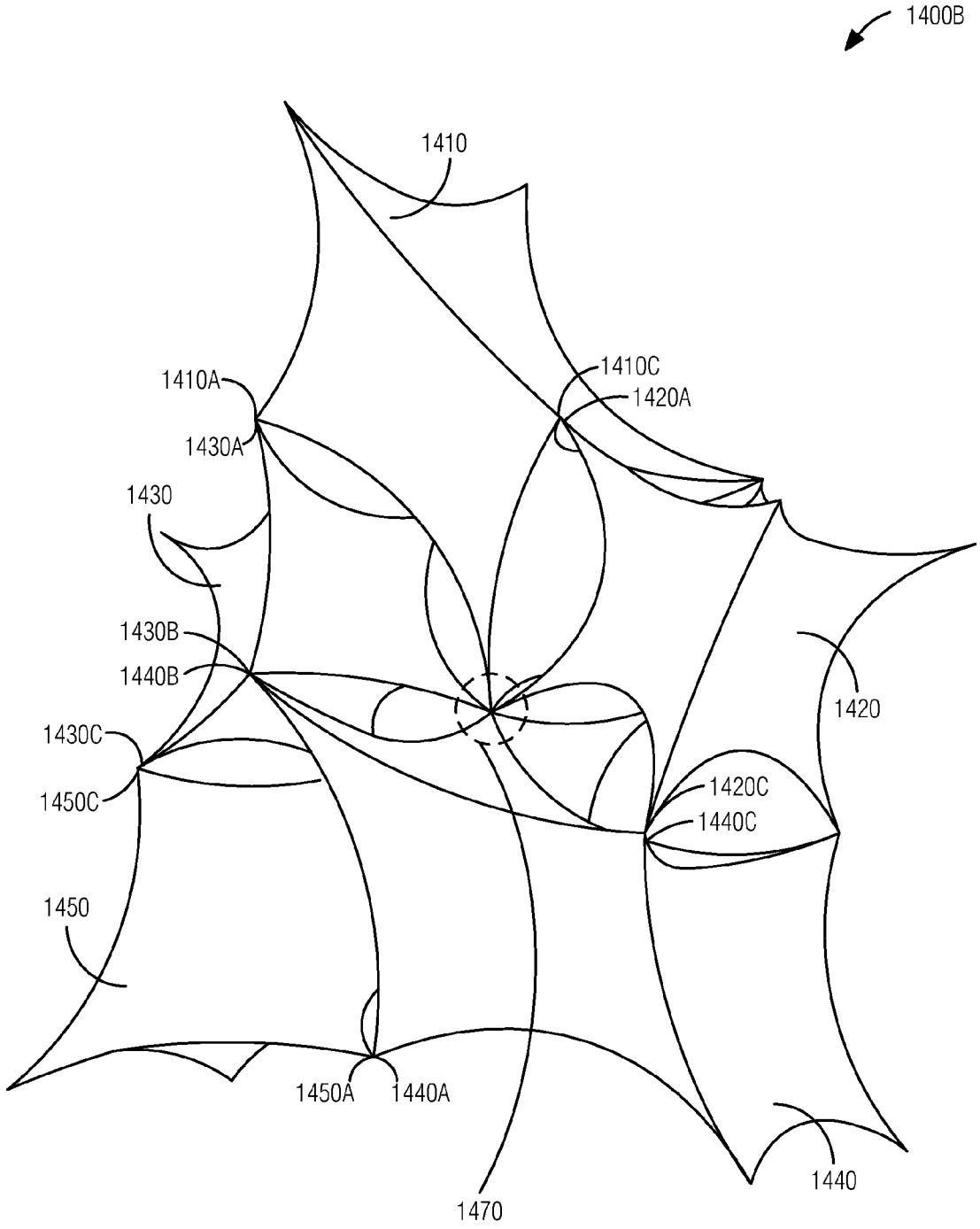

FIGS. 14A-14B are views of an enhanced building block combination 1400A-1400B, according to an embodiment. The enhanced building block combination includes five of the sixth example enhanced building blocks 1300 connected at various vertices. Each of the lettered vertices in FIGS. 14A-14B correspond to respective lettered vertices in FIG. 13B. For example, vertex 1410A corresponds to vertex 1300A, 1410C corresponds to vertex 1300C, et cetera.

FIG. 14A shows a front view of the enhanced building block combination 1400A, whereas FIG. 14B shows a perspective view of the enhanced building block combination 1400B. Though enhanced building block combination 1400A is symmetrical across a vertical plane into the page, FIGS. 14A-14B are drawn to include perspective to facilitate description. Due to the complex arrangement of the five building blocks 1300 into enhanced building block combination 1400A-1400B, it may be helpful to compare the locations of each of the five building blocks 1300 and common vertices by referring back and forth between FIGS. 14A and 14B. Block combination 1400A in FIG. 14A has been rotated to show block combination 1400B in FIG. 14B. For example, the bottom enhanced building block 1450 in FIG. 14A is rotated away from the viewer to the left as shown in FIG. 14B.

As shown in FIG. 14A, all five building blocks 1300 are connected to each other on at least one vertex at a central location 1460. Blocks 1410 and 1420 are connected on a first pair of vertices 1410C and 1420A. Blocks 1410 and 1430 are connected on a second pair of vertices 1410A and 1430A, and blocks 1420 and 1440 are connected on a third pair of vertices 1420C and 1440C. Similarly, blocks 1430 and 1440 are connected to block 1450 on a fourth pair of vertices 1430C and 1450C, and on a fifth pair of vertices 1440A and 1450A, and on.

As described above, FIG. 14B shows the same block combination 1400A rotated to the left to show a perspective view. FIG. 14B shows the same set of vertices as shown in FIG. 14A, including central location 1470. While central location 1460 in FIG. 14A includes several vertices including the frontmost pair of vertices 1430B and 1440B, the central location 1470 in FIG. 14B includes only vertices 1410G, 1420G, 1430H, 1440H, and 1450G.

FIGS. 15A-15B are perspective views of a seventh example enhanced building block 1500, according to an embodiment. A seventh example enhanced building block 1500 may be formed by warping and connecting four of elliptical shapes 1510-1540 coupled along the entire length of their edges. For example, the entire length of edge 1510B may be connected to the entire length of 1540A. Elliptical shapes 1510-1540 may be formed from four elliptical shapes congruent to shape 110 shown in FIG. 1, from four elliptical shapes congruent to shape 410 shown in FIG. 4, or from other elliptical shapes. The side perspective view shown in FIG. 15A presents the first two surfaces 1510 and 1540 to the viewer, where the third and fourth surfaces 1520 and 1530 are behind first surface. Similarly, the top perspective view shown in FIG. 15B shows the first and second surfaces 1510 and 1540, occluding the third and fourth surfaces 1520 and 1530.

Figure 16:
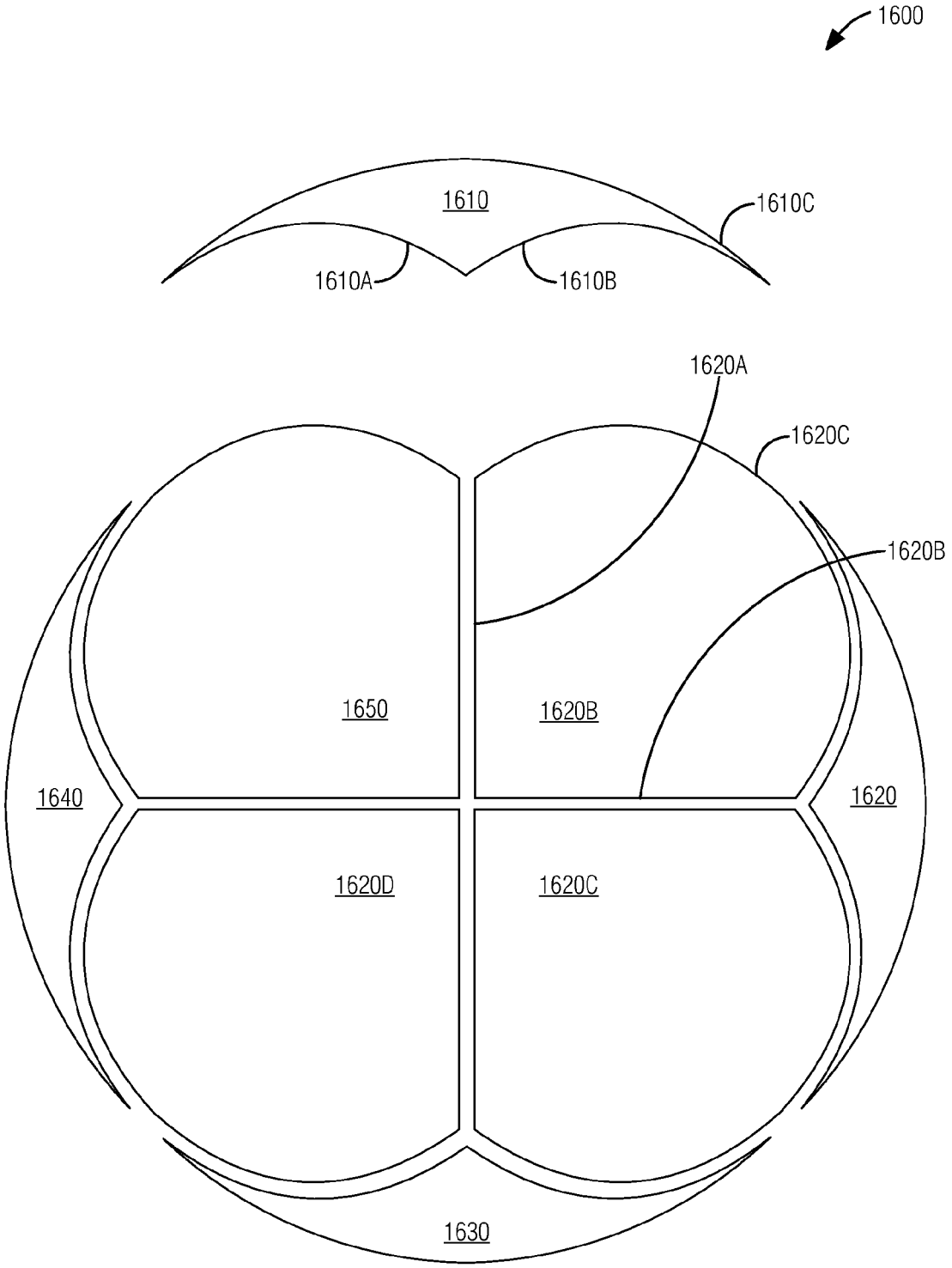
FIG. 16 is a front view of a sixth set of shapes that may be used to form an enhanced building block.

FIG. 16 is a front view of a sixth set of shapes 1600 that may be used to form an enhanced building block, according to an embodiment. In an embodiment, a circular shape is separated using a plurality of arcs to form multiple examples of two shapes. The arcs may form four mutually congruent, three-pointed shapes, such as 1610-1640. A center portion may be transected into an additional four mutually congruent shapes, such as 1620A-1620D. One or more of these two-dimensional shapes may be combined with other two-dimensional shapes to form one or more three-dimensional enhanced devices. For example, four shapes 1610-1640 may be combined with four shapes congruent to shape 430 in FIG. 4 to form a three-dimensional enhanced device similar to the fourth example enhanced building block 900 shown in FIG. 9.

Figure 17:
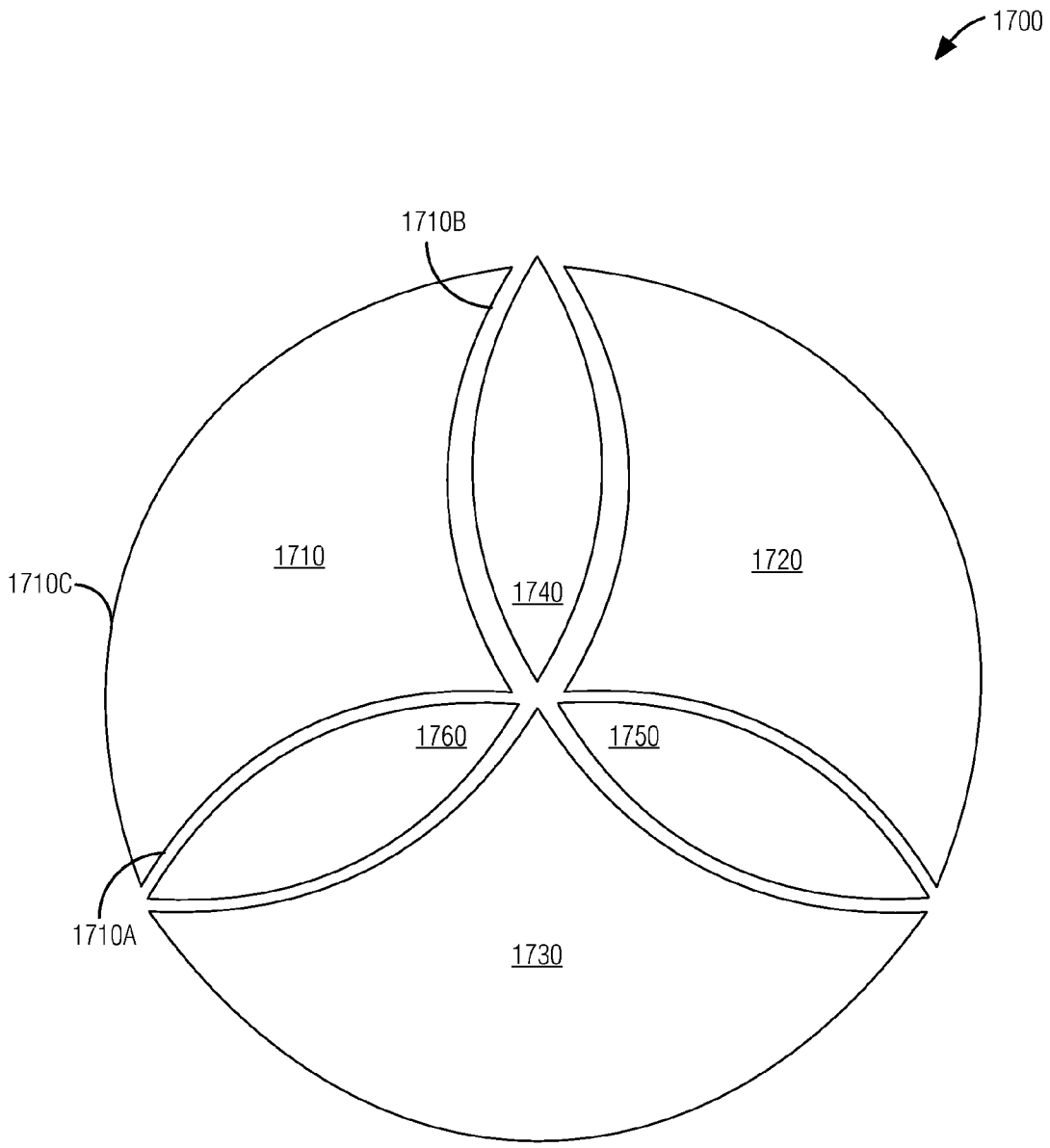
FIG. 17 is a front view of a seventh set of shapes that may be used to form an enhanced building block.

FIG. 17 is a front view of a seventh set of shapes 1700 that may be used to form an enhanced building block, according to an embodiment. In an embodiment, a circular shape is separated using a plurality of arcs to form multiple examples of two shapes. The arcs may form three mutually congruent, three-pointed shapes, such as 1710-1730. Two of the arcs may form three mutually congruent, two-pointed ellipsoid shapes, such as 1740-1760. One or more of these two-dimensional shapes may be combined with other two-dimensional shapes to form one or more three-dimensional enhanced devices, such as using six of the three-pointed shapes 1710 as shown in FIGS. 18A-18B.

Figure 18A:
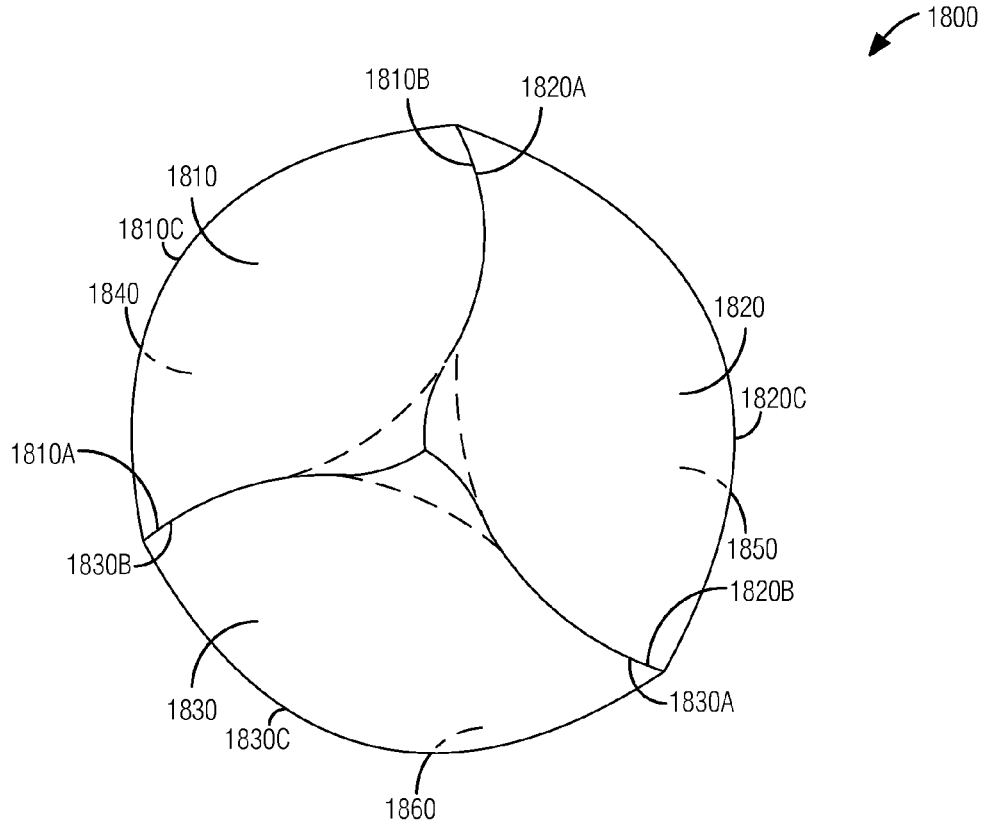
FIGS. 18A-18B are views of an eighth example enhanced building block.
Figure 18B:
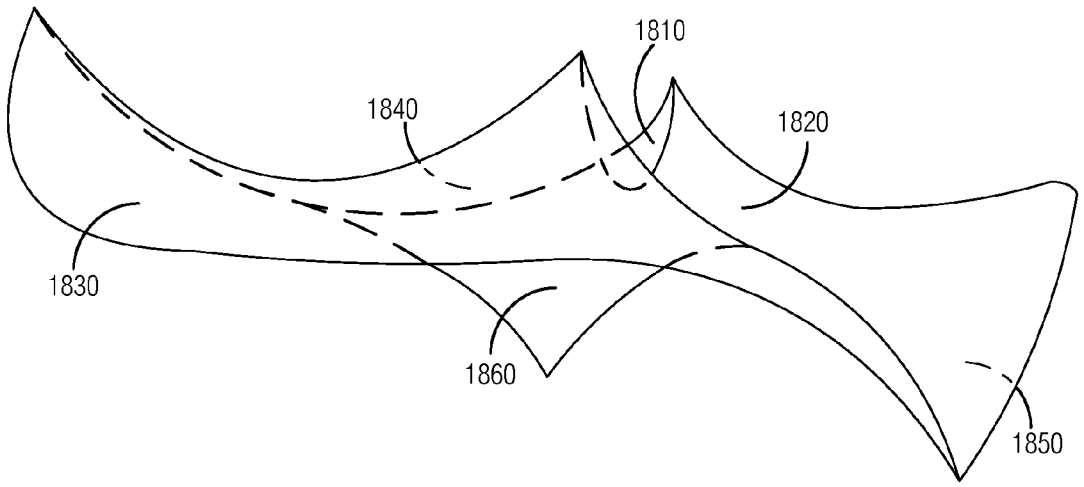

FIGS. 18A-18B are views of an eighth example enhanced building block 1800, according to an embodiment. In an embodiment, an eighth example enhanced building block 1800 may be formed using six of the three-pointed shapes 1710 shown in FIG. 17 coupled along the entire length of their edges. FIG. 18A is a top view of an eighth example enhanced building block 1800, whereas FIG. 18B is a perspective view of the eighth example enhanced building block 1800, according to an embodiment. Block 1800 is formed from six of the three-pointed shapes 1710, where the six shapes are grouped into coplanar pairs: 1810 is coplanar with 1840, 1820 is coplanar with 1850, and 1830 is coplanar with 1860. Because of the length of outer arcs 1810C, 1820C and 1830C, combining the coplanar pairs 1810-1830 includes deflecting outer corners upward or downward, as shown in FIG. 18B. Also as shown in FIG. 18B, the central point is formed by separating the central point of each coplanar pair into an upper vertex and lower vertex. In other embodiments, the eighth example enhanced building block 1800 may be formed using only three non-coplanar shapes 1710, where the central point is formed either into an upper vertex or into a lower vertex.

Figure 19A:
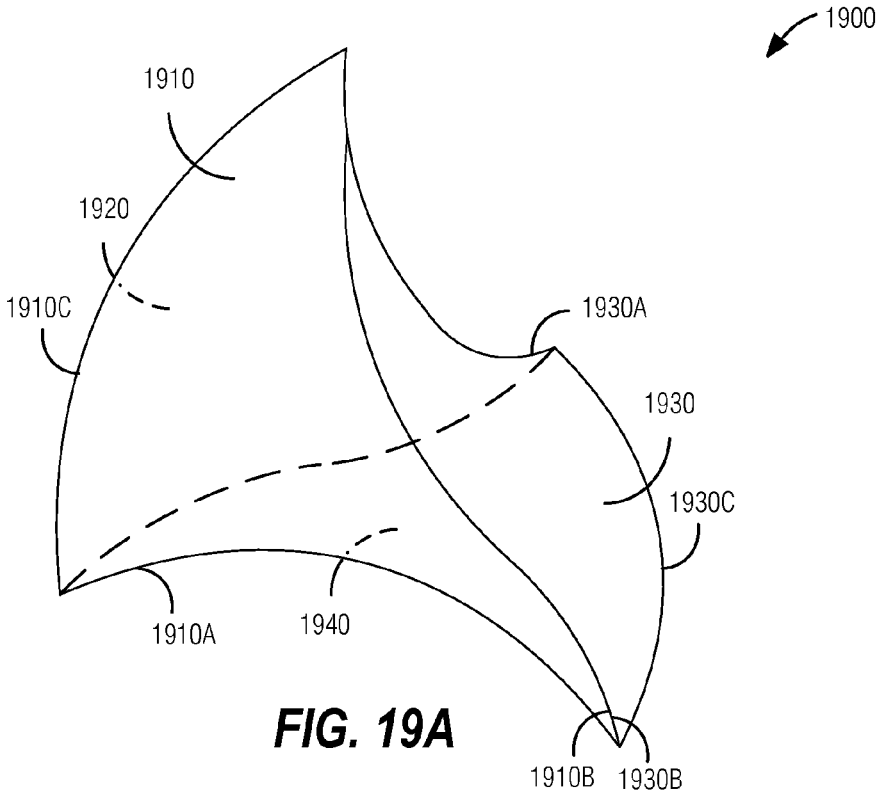
FIGS. 19A-19B are perspective views of a ninth example enhanced building block.
Figure 19B:
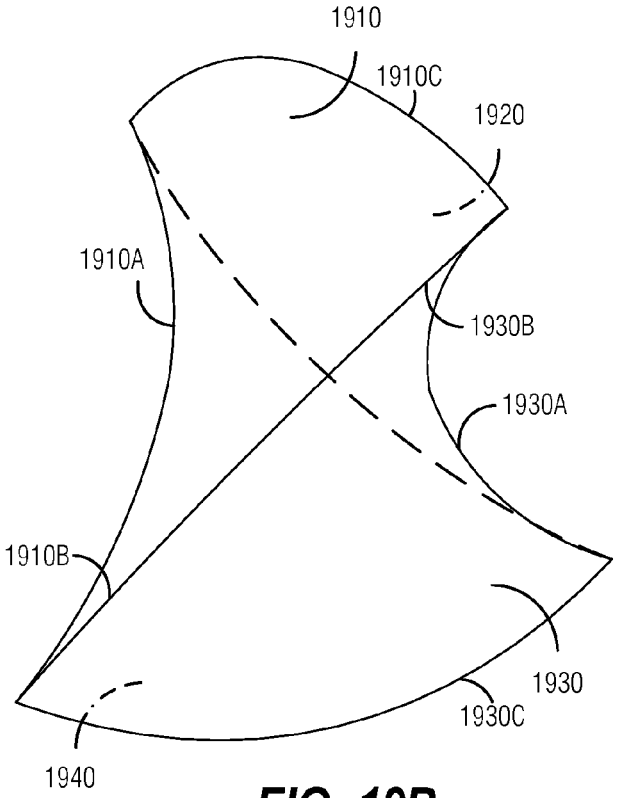

FIGS. 19A-19B are perspective views of a ninth example enhanced building block 1900, according to an embodiment. Using four of the shapes 440 shown in FIG. 4 coupled along the entire length of their edges, a ninth example enhanced building block 1900 may be formed. The perspective view shown in FIG. 19A presents the first two surfaces 1910 and 1930 to the viewer, where surfaces 1920 and 1940 are occluded by the other two surfaces. The perspective view shown in FIG. 19B also presents the first two surfaces 1910 and 1930 to the viewer, where surfaces 1920 and 1940 are again occluded by the other two surfaces.

Figure 20A:
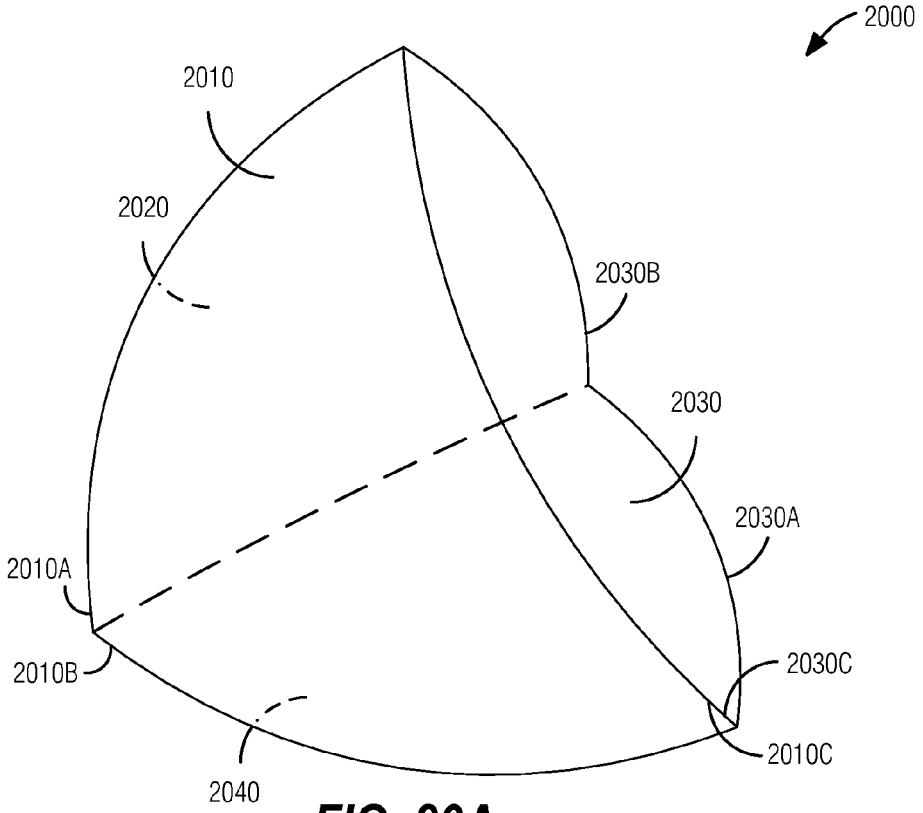
FIGS. 20A-20B are perspective views of a tenth example enhanced building block.
Figure 20B:
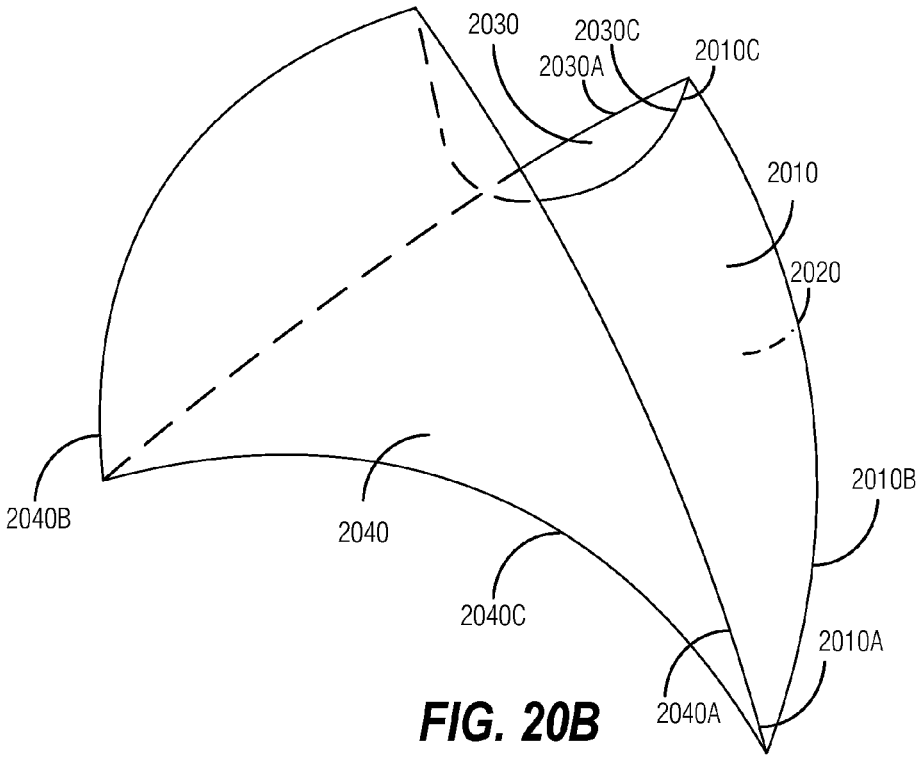

FIGS. 20A-20B are perspective views of a tenth example enhanced building block 2000, according to an embodiment. Using four of the shapes 420 shown in FIG. 4 coupled along the entire length of their edges, a tenth example enhanced building block 2000 may be formed. The perspective view shown in FIG. 20A presents the first two surfaces 2010 and 2030 to the viewer, where surfaces 2020 and 2040 are occluded by the other two surfaces. The perspective view shown in FIG. 20B presents surfaces 2010, 2030, and 2040 to the viewer, where surface 2020 is again occluded by the other two surfaces.

FIGS. 21A-21B are perspective views of an eleventh example enhanced building block 2100, according to an embodiment. Using three of the shapes 720A-720C shown in FIG. 7 coupled along the entire length of their edges, an eleventh example enhanced building block 2100 may be formed. The perspective view shown in FIG. 21A presents the first two surfaces 2110 and 2120 to the viewer, where the remaining surface 2130 is occluded by the first two surfaces. The perspective view shown in FIG. 21B presents surfaces 2120 and 2130 to the viewer, where the remaining surface 2110 is occluded.

Figure 22A:
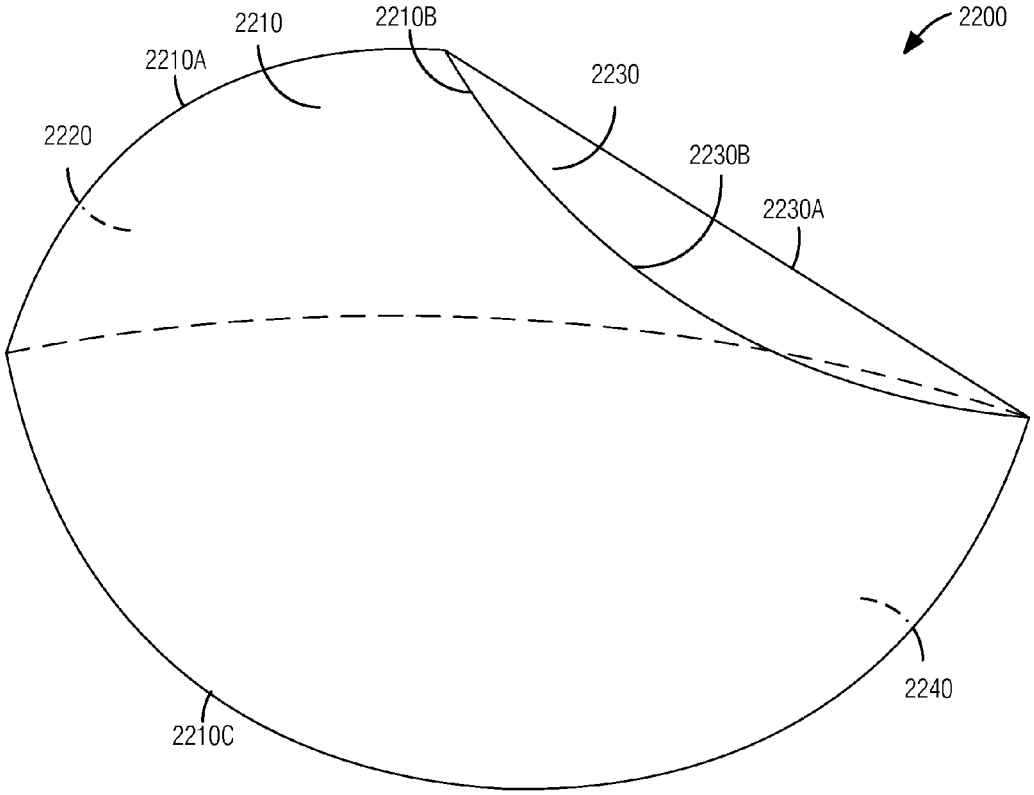
FIGS. 22A-22B are views of a twelfth example enhanced building block.
Figure 22B:
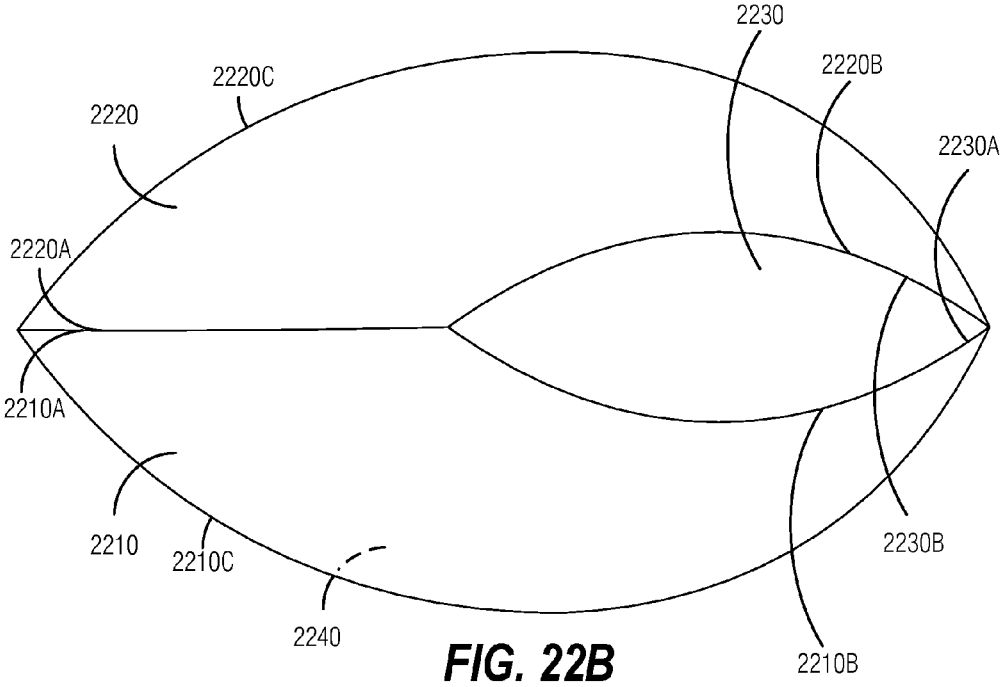

FIGS. 22A-22B are views of a twelfth example enhanced building block 2200, according to an embodiment. Using three of the shapes 140 shown in FIG. 1 coupled along the entire length of their edges, a twelfth example enhanced building block 2200 may be formed. An additional shape may be cut from two of the 140 shapes, where the cut shape is similar to elliptical shape 110 shown in FIG. 1. The side perspective view shown in FIG. 22A presents the first cut surface 2210 and the elliptical shape 2230, where the remaining cut surface 2220 and uncut shape 2240 is occluded by the first two surfaces. The top view shown in FIG. 22B presents the first two cut surfaces 2210 and 2220 joined by the cut shape 2230, where the remaining uncut surface 2240 is occluded.

Figure 23A:
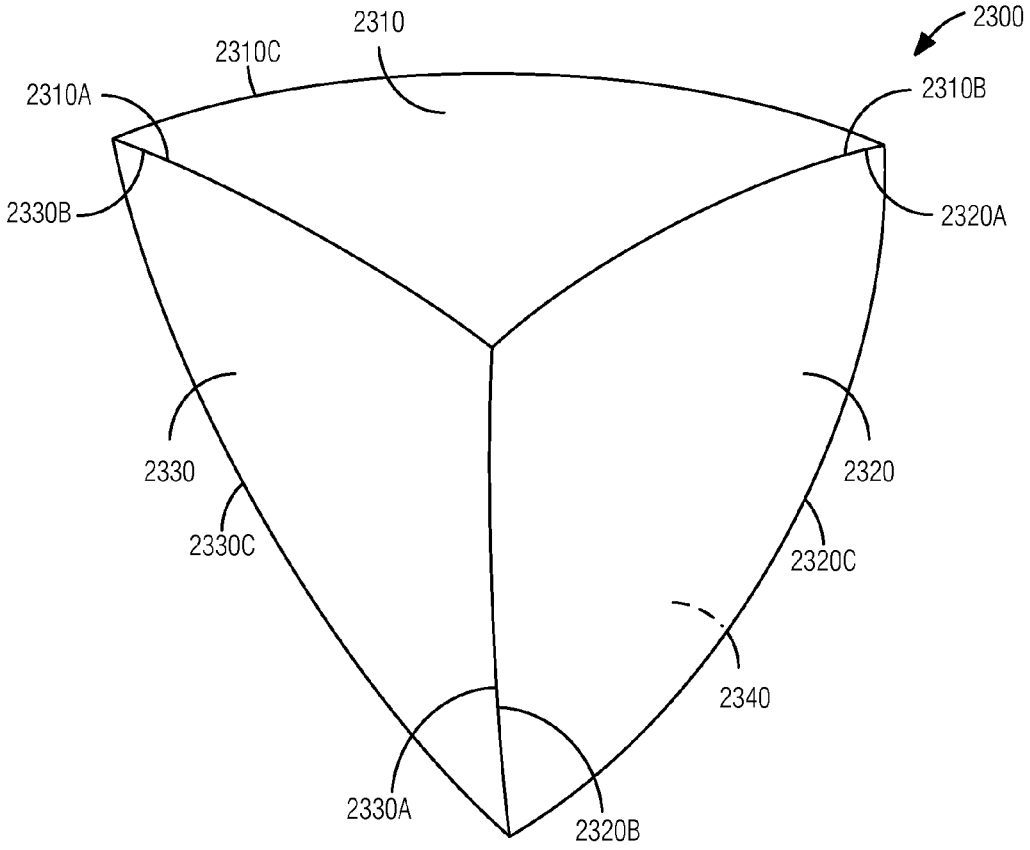
FIGS. 23A-23B are perspective views of a thirteenth example enhanced building block.
Figure 23B:
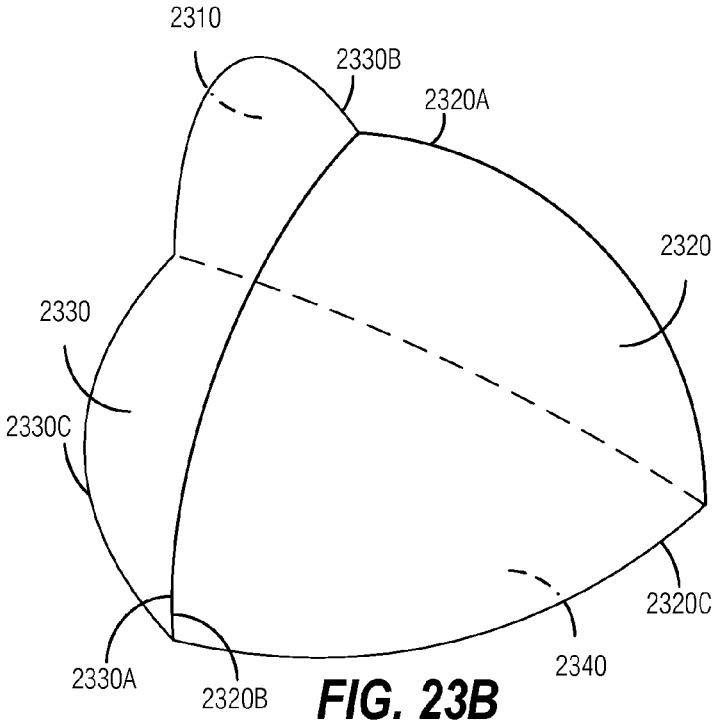

FIGS. 23A-23B are perspective views of a thirteenth example enhanced building block 2300, according to an embodiment. FIG. 23 is a perspective view of a thirteenth example enhanced building block 2300, according to an embodiment. Using four of the shapes 450 shown in FIG. 4 coupled along the entire length of their edges, a thirteenth example enhanced building block 2300 may be formed. The top perspective view shown in FIG. 23A presents the first three surfaces 2310-2330, where the remaining surface 2340 is occluded by the first three surfaces. The side perspective view shown in FIG. 23B presents two surfaces 2320 and 2330, where the remaining surfaces 2310 and 2340 are occluded.

Figure 24A:
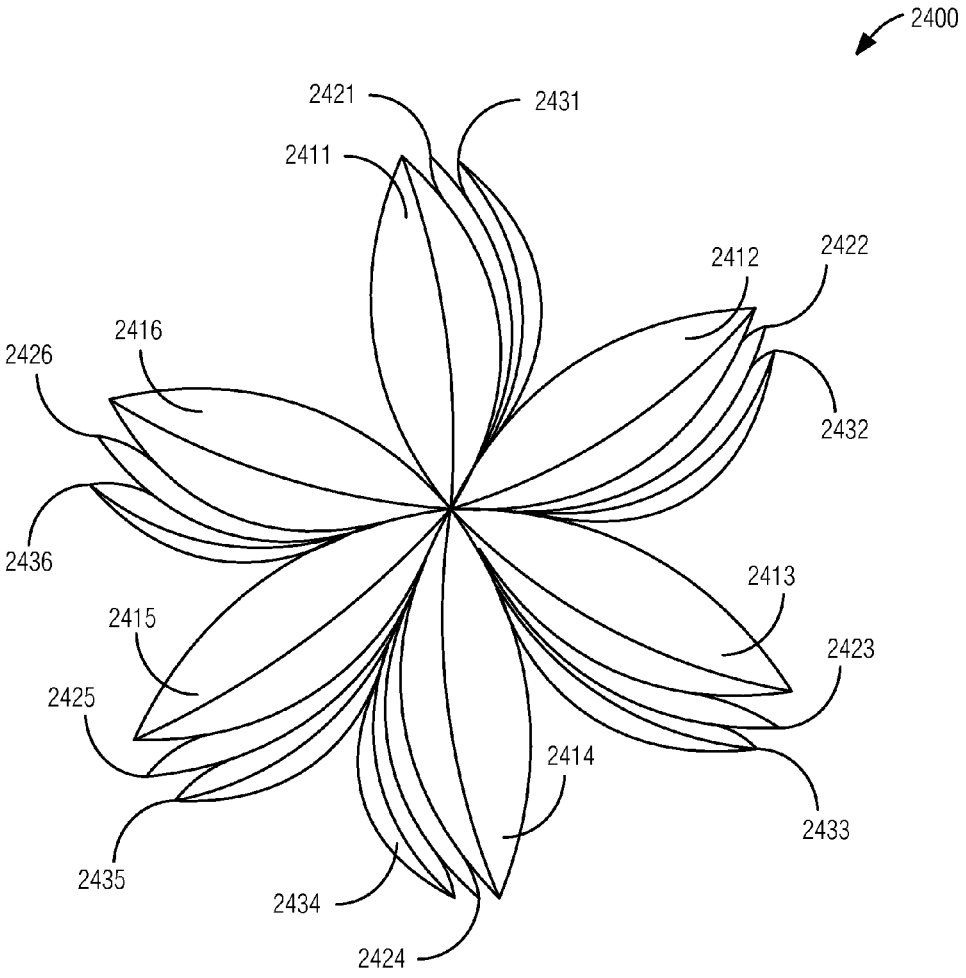
FIGS. 24A-24B are perspective views of a fourteenth example enhanced building block.
Figure 24B:
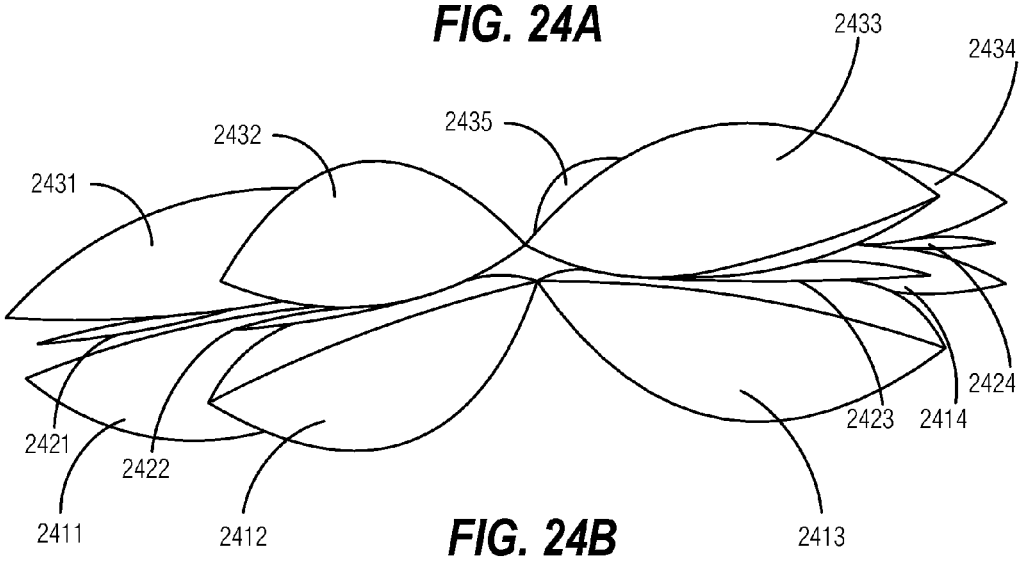

FIGS. 24A-24B are perspective views of a fourteenth example enhanced building block 2400, according to an embodiment. This building block 2400 may include a first group of six shapes 2411-2416. For example, building block 2400 may include a first group of six of the seventh example enhanced building blocks 1500 shown in FIG. 15, where the six three-dimensional building blocks 2411-2416 may be combined on a common vertex to form a star-shaped configuration. Each of the six building blocks 2411-2416 may be connected to respective two-dimensional elliptical shapes 2421-2426, such as two-dimensional shapes 110 shown in FIG. 1. The six two-dimensional elliptical shapes 2421-2426 may be combined on a common vertex to form a two-dimensional six-pointed star-shaped configuration. A second group of six three-dimensional blocks 2431-2436 may be combined in a second three-dimensional star-shaped configuration, where the second star-shaped configuration is connected to the two-dimensional star-shaped configuration opposite from the first three-dimensional star-shaped configuration. Additional elliptical shapes 110 may be connected to form further examples related to the fourteenth example enhanced building block 2400.

Figure 25A:
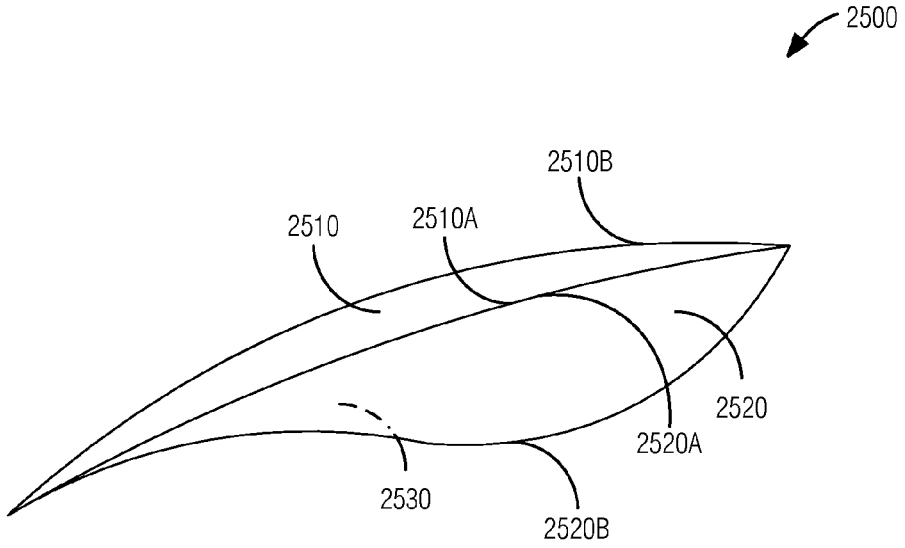
FIGS. 25A-25B are perspective views of a fifteenth example enhanced building block.
Figure 25B:
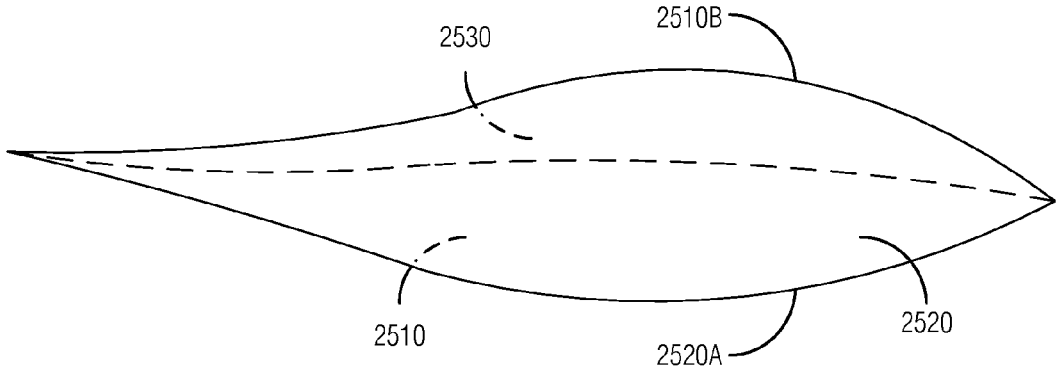

FIGS. 25A-25B are perspective views of a fifteenth example enhanced building block 2500, according to an embodiment. Using three, two-edged shapes 2510-2530 coupled along the entire length of their edges, a fifteenth example enhanced building block 2500 may be formed. The shapes 2510-2530 may be similar to shapes 720 shown in FIG. 7, though inner edge 720B may be less curved, resulting in a smaller area between inner edge 720B and outer edge 720A. The top perspective view shown in FIG. 25 presents the first two surfaces 2510 and 2520 to the viewer, where the remaining surface 2530 is occluded by the first two surfaces. The side perspective view shown in FIG. 25B presents surface 2520, where the remaining surfaces 2510 and 2530 are occluded.

Figure 26A:
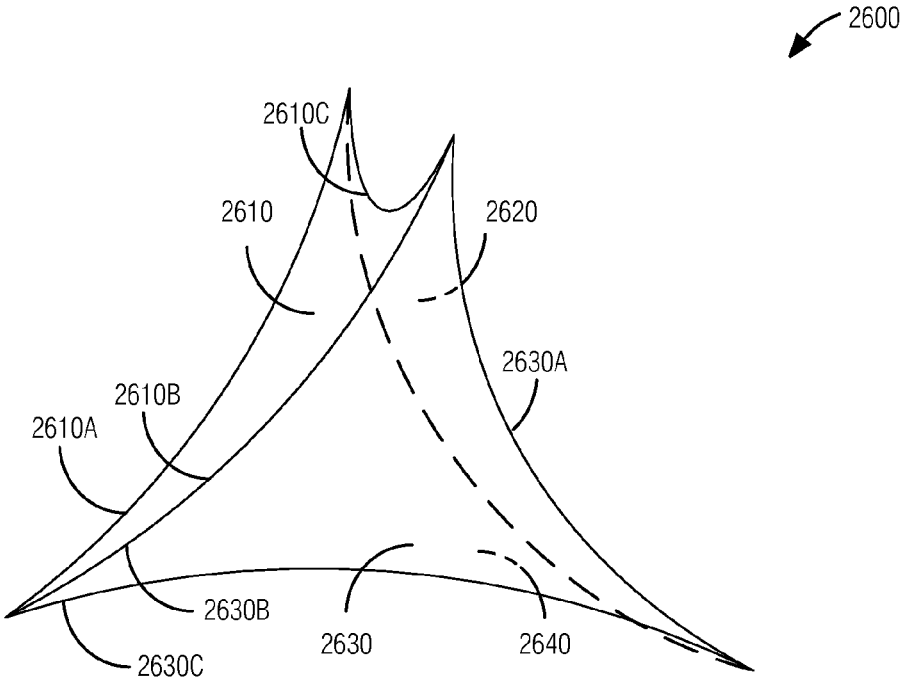
FIGS. 26A-26B are perspective views of a sixteenth example enhanced building block.
Figure 26B:
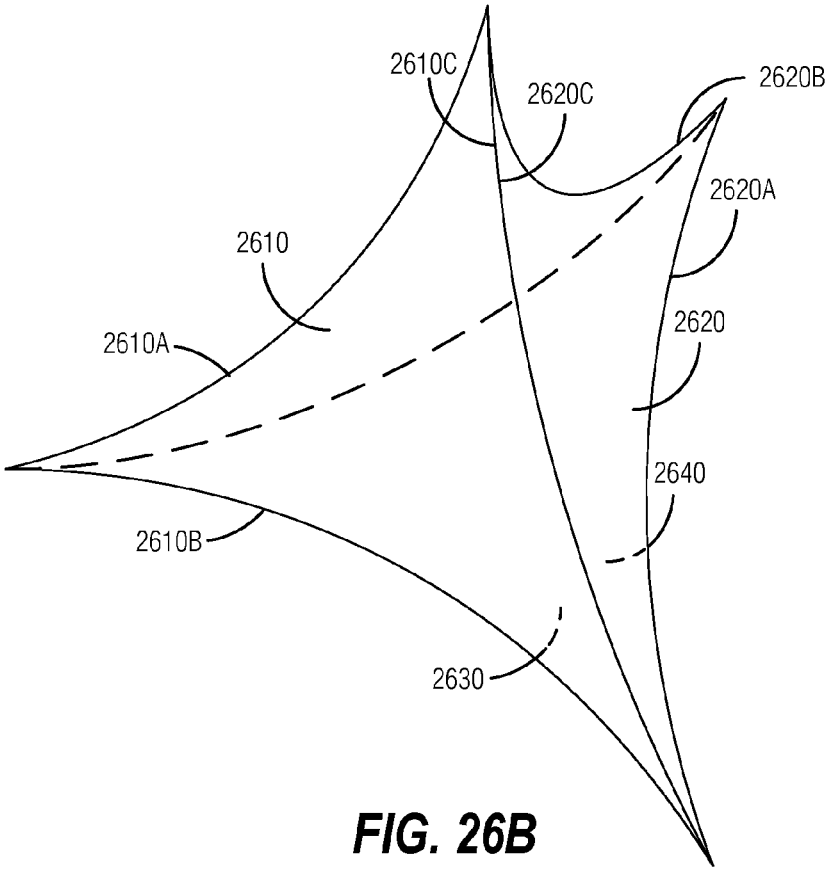

FIGS. 26A-26B are perspective views of a sixteenth example enhanced building block 2600, according to an embodiment. Using four of the shapes 430 shown in FIG. 4 coupled along the entire length of their edges, a sixteenth example enhanced building block 2600 may be formed. The perspective view shown in FIG. 26A presents surfaces 2610 and 2630, where remaining surfaces 2620 and 2640 are occluded. The perspective view shown in FIG. 26B presents surfaces 2610 and 2620, where remaining surfaces 2630 and 2640 are occluded.

Figure 27A:
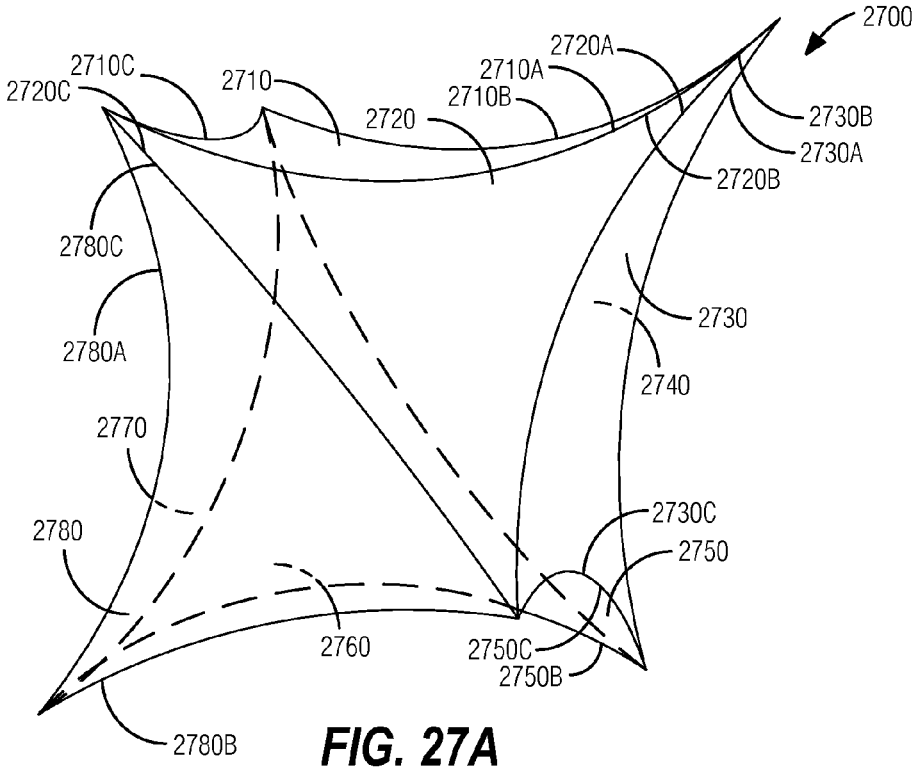
FIGS. 27A-27B are perspective views of a seventeenth example enhanced building block.
Figure 27B:
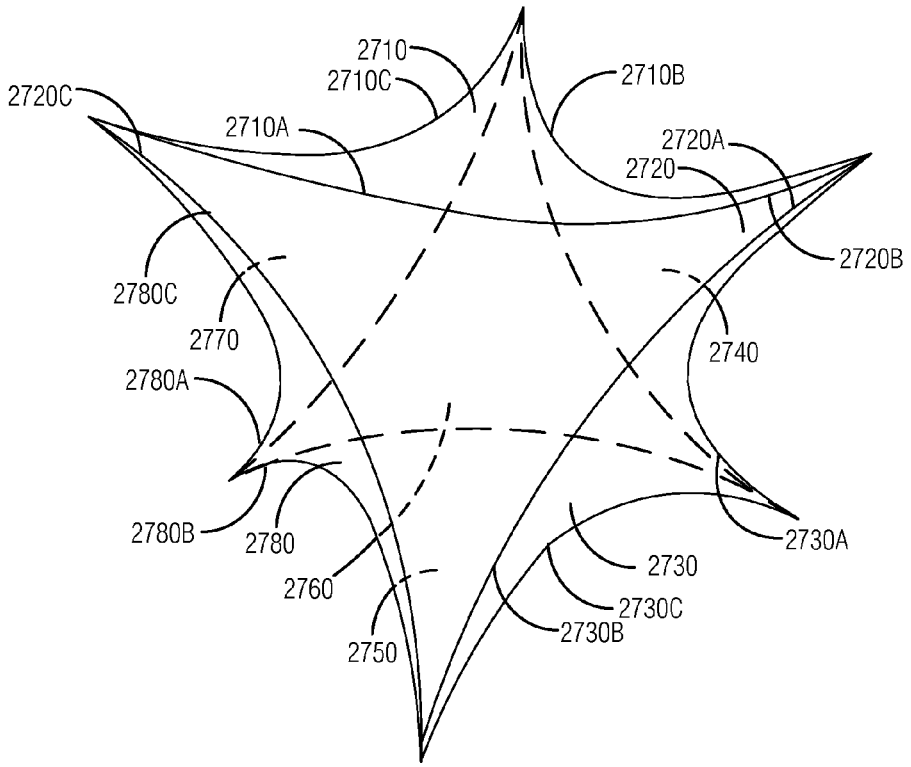

FIGS. 27A-27B are perspective views of a seventeenth example enhanced building block 2700, according to an embodiment. A seventeenth example enhanced building block 2700 may be formed using eight of the shapes 430 shown in FIG. 4 coupled along the entire length of their edges. For example, a first group of four shapes 2710-2740 may be configured to form a first square pyramid, a second group of four shapes 2750-2780 may be configured to form a second square pyramid, and the first square pyramid may be connected to the second square pyramid. The perspective view shown in FIG. 27A presents three shapes 2710, 2720, and 2730 on the top pyramid and shape 2750 and 2780 on the bottom pyramid, occluding the shape 2740 on the top pyramid and shapes 2760 and 2770 on the bottom pyramid. The perspective view shown in FIG. 27B also presents three shapes 2710, 2720, and 2730 on the top pyramid and shape 2780 on the bottom pyramid, occluding the shape 2740 on the top pyramid and shapes 2750, 2760, and 2770 on the bottom pyramid.

EXAMPLES

Example 1 includes a building block comprising a first substrate, a piezoelectric element disposed on the first substrate that generates an electric charge in response to vibration, and a light emitting diode disposed on the first substrate and electrically connected to the piezoelectric element, wherein the light emitting diode is configured to provide electroluminescence in response to the electric charge generated by piezoelectric element.

Example 1 includes a curvilinear tetrahedral enhanced building block comprising a first and second planar surfaces, the first and second planar surfaces each having three points and three edges, each edge having a sigmoid curve, the first and second planar surface having substantially the same shape and being coupled on the entire length of a first common edge to form a first warped surface group, a third and fourth planar surfaces, the third and fourth planar surfaces each having three points and three edges, each edge having an inverse sigmoid curve, the third and fourth planar surface having substantially the same shape and being coupled on the entire length of a second common edge to form a second warped surface group, wherein the first warped surface group is coupled to the second warped surface group such that the planar surfaces are warped and coupled by edges to form a curvilinear tetrahedral enhanced building block.

Example 2 includes the curvilinear tetrahedral enhanced building block of example 1, wherein the curvilinear tetrahedral enhanced building block includes a first, second, third, and fourth curved corner, each curved corner is configured to rotate respectively around a first, second, third, and fourth axis, and the first, second, third, and fourth axes are substantially mutually orthogonal.

Example 3 includes the curvilinear tetrahedral enhanced building block of any of examples 1-2, wherein a curvature of the first curved corner is arranged to exert a first force against a viscous medium while rotating in a first direction around the first axis and to exert a second force against the viscous medium while rotating in a second direction around the first axis, the first force greater than the second force, and rotating the first curved corner in a first direction causes a motion in a first direction of the curvilinear tetrahedral enhanced building block within the viscous medium.

Example 4 includes the curvilinear tetrahedral enhanced building block of example 1, further including a conductive element.

Example 5 includes the curvilinear tetrahedral enhanced building block of any of examples 1-4, wherein the conductive element is disposed on an outer surface of the curvilinear tetrahedral enhanced building block.

Example 6 includes the curvilinear tetrahedral enhanced building block of any of examples 1-4, wherein the conductive element is configured to generate an electrostatic field.

Example 7 includes the curvilinear tetrahedral enhanced building block of any of examples 1-6, wherein the electrostatic field is configured to induce motion in a dielectric fluid surrounding the curvilinear tetrahedral enhanced building block.

Example 8 includes the curvilinear tetrahedral enhanced building block of any of examples 1-4, further including a magnetic element configured to generate a magnetic field.

Example 9 includes the curvilinear tetrahedral enhanced building block of any of examples 1-8, wherein the magnetic element is disposed within the curvilinear tetrahedral enhanced building block.

Example 10 includes the curvilinear tetrahedral enhanced building block of any of examples 1-9, wherein the conductive element is configured to conduct electricity to the dielectric fluid surrounding the curvilinear tetrahedral enhanced building block, the magnetic element is configured to generate a magnetic field within the dielectric fluid, the generation of the magnetic field inducing magnetohydrodynamic motion within the dielectric fluid.

Example 11 includes the curvilinear tetrahedral enhanced building block of example 1, further including a power source configured to supply power to the conductive element.

Example 12 includes the curvilinear tetrahedral enhanced building block of any of examples 1-4, further including a piezoelectric element coupled to the conductive element.

Example 13 includes the curvilinear tetrahedral enhanced building block of example 12, wherein the piezoelectric element is configured to convert a received mechanical vibration into a piezoelectric charge.

Example 14 includes the curvilinear tetrahedral enhanced building block of example 12, wherein the piezoelectric element is configured to convert a received electrical charge into a piezoelectromechanical vibration.

Example 15 includes the curvilinear tetrahedral enhanced building block of example 1, wherein the first planar surface is configured to deform in a first planar deformation direction to generate lift across the first planar surface.

Example 16 includes the curvilinear tetrahedral enhanced building block of example 15, wherein the first planar surface is configured to deform in a second planar deformation direction to generate drag across the first planar surface.

Example 17 includes the curvilinear tetrahedral enhanced building block of example 15, wherein the first, second, third, and fourth planar surfaces are configured to deform in a first tetrahedral deformation configuration to promote rotation of the curvilinear tetrahedral enhanced building block in a first tetrahedral direction.

Example 18 includes the curvilinear tetrahedral enhanced building block of example 1, further including a directional flange, the directional flange configured to promote rotation of the curvilinear tetrahedral enhanced building block in a second tetrahedral direction.

This invention is intended to cover all changes and modifications of the example embodiments described herein that do not constitute departures from the scope of the claims.

What is claimed is:

1. A curvilinear tetrahedral enhanced building block comprising:

a first and second planar surfaces, the first and second planar surfaces each having three points and three edges, each edge having a first sigmoid curve, the first and second planar surface having substantially the same shape and being coupled on the entire length of a first common edge to form a first warped surface group;

a third and fourth planar surfaces, the third and fourth planar surfaces each having three points and three edges, each edge having a second sigmoid curve, the second sigmoid curve direction of curvature being opposite from the first sigmoid curve direction of curvature, the third and fourth planar surface having substantially the same shape and being coupled on the entire length of a second common edge to form a second warped surface group;

wherein the first warped surface group is coupled to the second warped surface group such that the planar surfaces are warped and coupled by edges to form a curvilinear tetrahedral enhanced building block.

2. The curvilinear tetrahedral enhanced building block of claim 1, wherein:

the curvilinear tetrahedral enhanced building block includes a first, second, third, and fourth curved corner;

each curved corner is configured to rotate respectively around a first, second, third, and fourth axis; and the first, second, third, and fourth axes are substantially mutually orthogonal.

3. The curvilinear tetrahedral enhanced building block of claim 2, wherein:

a curvature of the first curved corner is arranged to exert a first force against a viscous medium while rotating in a first direction around the first axis and to exert a second force against the viscous medium while rotating in a second direction around the first axis;

the first force greater than the second force; and rotating the first curved corner in a first direction causes a motion in a first direction of the curvilinear tetrahedral enhanced building block within the viscous medium.

4. The curvilinear tetrahedral enhanced building block of claim 1, further including a conductive element.

5. The curvilinear tetrahedral enhanced building block of claim 4, wherein the conductive element is disposed on an outer surface of the curvilinear tetrahedral enhanced building block.

6. The curvilinear tetrahedral enhanced building block of claim 4, wherein the conductive element is configured to generate an electrostatic field.

7. The curvilinear tetrahedral enhanced building block of claim 6, wherein the electrostatic field is configured to induce motion in a dielectric fluid surrounding the curvilinear tetrahedral enhanced building block.

8. The curvilinear tetrahedral enhanced building block of claim 4, further including a magnetic element configured to generate a magnetic field.

9. The curvilinear tetrahedral enhanced building block of claim 8, wherein the magnetic element is disposed within the curvilinear tetrahedral enhanced building block.

10. The curvilinear tetrahedral enhanced building block of claim 9, wherein:

the conductive element is configured to conduct electricity to the dielectric fluid surrounding the curvilinear tetrahedral enhanced building block;

the magnetic element is configured to generate a magnetic field within the dielectric fluid, the generation of the magnetic field inducing magnetohydrodynamic motion within the dielectric fluid.

11. The curvilinear tetrahedral enhanced building block of claim 4, further including a power source configured to supply power to the conductive element.

12. The curvilinear tetrahedral enhanced building block of claim 4, further including a piezoelectric element coupled to the conductive element.

13. The curvilinear tetrahedral enhanced building block of claim 12, wherein the piezoelectric element is configured to convert a received mechanical vibration into a piezoelectric charge.

14. The curvilinear tetrahedral enhanced building block of claim 12, wherein the piezoelectric element is configured to convert a received electrical charge into a piezoelectromechanical vibration.

15. The curvilinear tetrahedral enhanced building block of claim 1, wherein the first planar surface is configured to deform in a first planar deformation direction to generate lift across the first planar surface.

16. The curvilinear tetrahedral enhanced building block of claim 15, wherein the first planar surface is configured to deform in a second planar deformation direction to generate drag across the first planar surface.

17. The curvilinear tetrahedral enhanced building block of claim 15, wherein the first, second, third, and fourth planar surfaces are configured to deform in a first tetrahedral deformation configuration to promote rotation of the curvilinear tetrahedral enhanced building block in a first tetrahedral direction.

18. The curvilinear tetrahedral enhanced building block of claim 1, further including a directional flange, the directional flange configured to promote rotation of the curvilinear tetrahedral enhanced building block in a second tetrahedral direction.

* * * * *